US005447015A

United States Patent [19]

Belec et al.

[11] Patent Number: 5,447,015

[45] Date of Patent: Sep. 5, 1995

[54] HIGH SPEED INSERTION DEVICE

[75] Inventors: Eric A. Belec, Southbury; William J. Wright, Killingworth, both of Conn.

[73] Assignee: Pitney Bowes Inc., Stamford, Conn.

[21] Appl. No.: 144,466

[22] Filed: Nov. 1, 1993

[51] Int. Cl.[6] ..... B65B 43/26

[52] U.S. Cl. ..... 53/492; 53/381.5; 53/381.6; 53/569; 53/284.3; 271/271

[58] Field of Search ..... 53/53, 54, 258, 259, 53/266.1, 284.3, 381.5, 381.6, 460, 492, 569; 271/269, 271, 276

[56] References Cited

U.S. PATENT DOCUMENTS

| | | | |
|---|---|---|---|
| Re. 28,350 | 3/1975 | Lerner | 53/492 |
| 3,583,124 | 6/1971 | Morrison | 53/492 |
| 4,211,399 | 7/1980 | McGowan | 271/232 |
| 4,337,609 | 7/1982 | Foster et al. | 53/569 |
| 4,379,383 | 4/1983 | Adamoski et al. | 53/266 |
| 4,411,420 | 10/1983 | Louis et al. | 271/276 |
| 4,443,007 | 4/1984 | Adamoski et al. | 271/269 |
| 4,649,691 | 3/1987 | Backholz . | |
| 4,674,258 | 6/1987 | Ehlscheld et al. | 53/154 |
| 4,753,429 | 6/1988 | Irvine et al. | 271/184 |
| 4,775,140 | 10/1988 | Foster | 271/121 |
| 4,888,938 | 12/1989 | Auerbach et al. | 53/569 |
| 4,903,456 | 2/1990 | Muer | 53/69 |
| 4,903,461 | 2/1990 | Dimur | 53/569 |
| 4,922,689 | 5/1990 | Haas et al. | 53/569 |
| 4,944,137 | 7/1990 | Krasuski et al. | 53/569 |
| 4,962,624 | 10/1990 | Foster et al. | 53/76 |
| 5,042,232 | 8/1991 | Orsinger et al. | 53/460 |
| 5,125,214 | 6/1992 | Orsinger et al. | 53/460 |
| 5,168,689 | 12/1992 | Macelis | 53/381.5 |
| 5,191,751 | 3/1993 | Marzullo et al. | 53/569 |
| 5,247,780 | 9/1993 | Kulpa et al. | 53/381.6 |
| 5,255,498 | 10/1993 | Hotchkiss et al. | 53/381.5 |

*Primary Examiner*—W. Donald Bray
*Attorney, Agent, or Firm*—Charles R. Malandra, Jr.; Melvin J. Scolnick

[57] ABSTRACT

In accordance with the present invention apparatus for inserting enclosures into an envelope comprises an insertion section and an envelope staging section located upstream and below the insertion section. The envelope staging section includes structure for holding and forwarding an envelope fed from an envelope feeder. Envelope transport structure transports an envelope forwarded from the envelope staging section to the insertion section. The envelope transport structure includes a vacuum deck located at the insertion section and a vacuum drum located between the envelope staging section and the vacuum deck. The envelope transport structure further includes a plurality of envelope transport belts operating in cooperation with the vacuum drum and the vacuum deck. A plurality of backstops are located at the downstream end of the insertion section. A pivoting sucker bar assembly lifts open a top panel of the envelope when the envelope is against the backstops. A pair of rotating funnel guide horns guide enclosures being conveyed for insertion into the envelope. A dual belted enclosure transport assembly located upstream of the insertion section transports a collation toward the insertion section. A plurality of overhead pushers seize the enclosures from the enclosure transport, stuff the enclosures into the opened envelope and push the stuffed envelope from the insertion section into engagement by output belts that are located downstream from the insertion section and above the envelope transport belts.

12 Claims, 20 Drawing Sheets

HIGH SPEED INSERTION DEVICE

FIELD OF THE INVENTION

The invention disclosed herein relates generally to apparatus for inserting documents into envelopes, and more particularly, to inserting stations in high speed inserting machines.

RELATED APPLICATIONS

The present application is related to U.S. application Ser. Nos. 08/084,908, filed Jul. 2, 1993; 08/037,842, filed Mar. 29, 1993; 08/074,528, filed Jun. 11, 1993, [Attorney Docket E-119], filed concurrently herewith; and [Attorney Docket E-120], filed concurrently herewith; and all assigned to the assignee of the present invention.

BACKGROUND OF THE INVENTION

Various types of envelope stuffing apparatus are well known. Earlier methods of envelope stuffing apparatus included a ram for stuffing enclosures into awaiting envelopes. See, for example, U.S. Pat. Nos. 4,443,007, 4,337,609 and 4,379,383. Alternate methods include biased belts for stuffing enclosures into an opened envelopes. See, for example, U.S. Pat. Nos. 4,888,938 and 5,191,751. As the throughput of inserting machines has increased the speed and reliability of the envelope stuffing apparatus has become more critical.

More recent methods of envelope stuffing apparatus have attempted to improve the speed and reliability of the inserting operation. For example, U.S. Pat. application Ser. No. 07/608,515, filed Nov. 2, 1990, discloses an envelope stuffing apparatus including coplanar first and second pusher means for transporting enclosures into an envelope.

Another example of an envelope stuffing apparatus is disclosed in U.S. Pat. No. 5,125,214. The apparatus includes a gripper drum for delivering envelopes to the inserting location, vacuum means for holding the bottom surface of the envelope as suction cups lift the top surface, and drop rollers for urging the stuffed envelope out of the inserting location. There is an insert pusher that retracts downwardly and backwardly out of the way of envelopes and enclosures being provided to the inserting location.

A further example is U.S. Pat. No. 4,674,258 which discloses an envelope stuffing apparatus in which enclosures are inserted by upper and lower belts and envelopes are transported to the inserting location by suction belts.

Finally, a complex insertion station is disclosed in U.S. Pat. No. 4,922,689 which includes a linearly reciprocating carriage that carries a plurality of pusher fingers.

It is an object of the present invention to provide an apparatus and method that simplifies the insertion process while increasing both the throughput and the reliability of the insertion station.

SUMMARY OF THE INVENTION

The present invention provides a high speed insertion device that improves reliability of the inserting operation without impacting the throughput of the machine. It has been found that in envelope can be transported to an insertion area, stopped and deskewed while under the control of a continuously running, non-positive drive, vacuum and belt transport.

It has also been found that a non-rotating vacuum drum can be used with a belt transport to change the direction of an envelope being moved from an envelope arming station to the continuously running vacuum and belt transport.

It has further been found that an overhead pusher arrangement can be used to insert a collation into an opened envelope and to remove the stuffed envelope from the insertion area. The present invention can operate either synchronously or asynchronously.

In accordance with the present invention apparatus for inserting enclosures into an envelope comprises an insertion section and an envelope staging section located upstream and below the insertion section. The envelope staging section includes means for holding and forwarding an envelope fed from an envelope feeder. Envelope transport means transport an envelope forwarded from the envelope staging section to the insertion section. The envelope transport means include a vacuum deck located at the insertion section and a vacuum drum located between the envelope staging section and the vacuum deck. The envelope transport means further includes a plurality of envelope transport belts operating in cooperation with the vacuum drum and the vacuum deck. The vacuum deck and the vacuum drum each have vacuum means for holding a bottom panel of the envelope against the envelope transport belts. A plurality of backstops are located at the downstream end of the insertion section. A pivoting sucker bar assembly lifts open a top panel of the envelope when the envelope is against the backstops. A pair of rotating funnel guide horns guide enclosures being inserted into the envelope. A dual belted enclosure transport assembly located upstream of the insertion section transports a collation to the insertion section. A plurality of laterally spaced overhead pushers are located above at least part of the enclosure transport assembly and the insertion section, and a plurality of output belts are located downstream from the insertion section and above the envelope transport belts. The overhead pushers seize the enclosures from the enclosure transport, stuff the enclosures into the opened envelope and push the stuffed envelope from the insertion section into engagement by the output belts.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
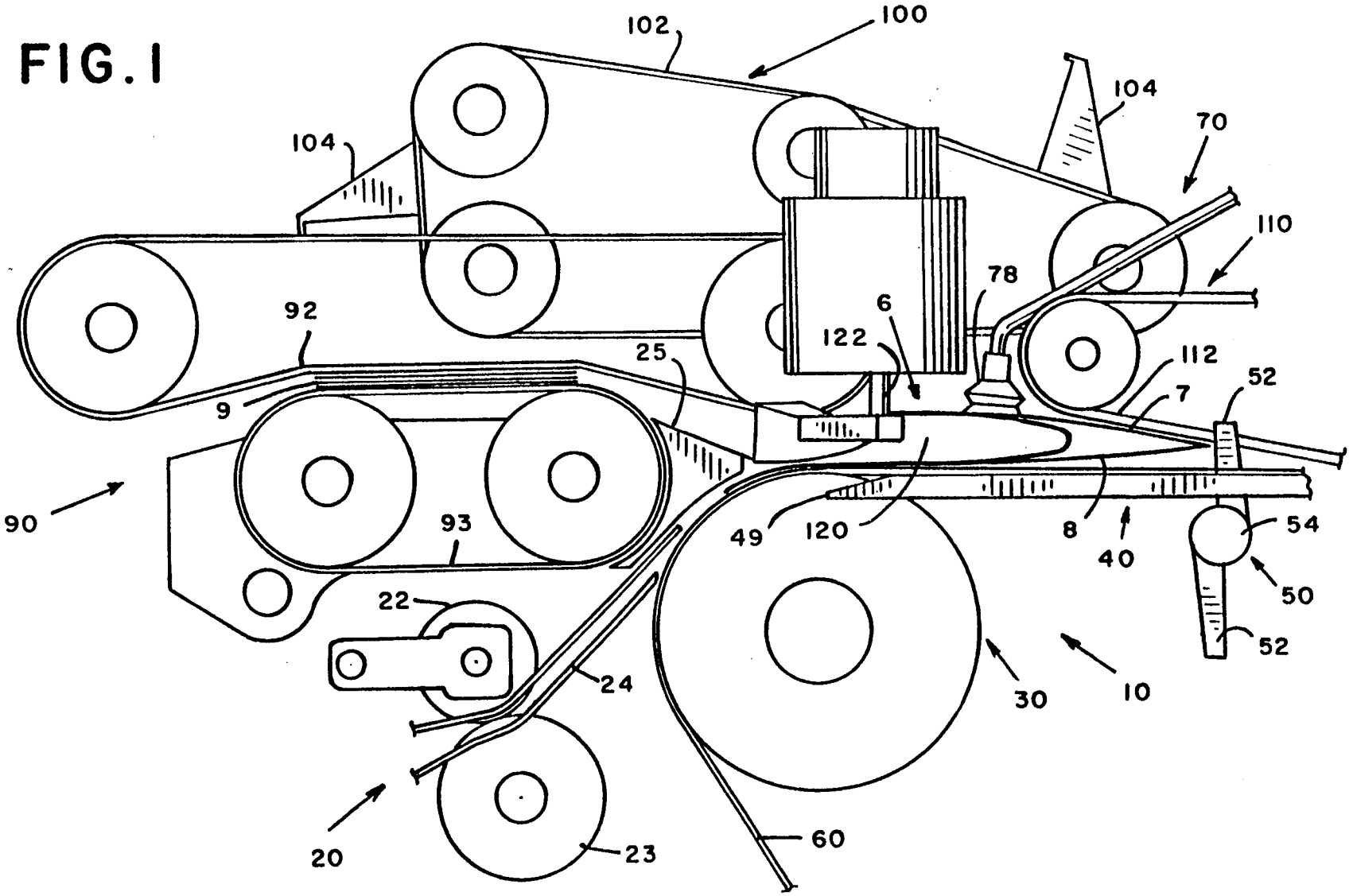
FIG. 1 is a side elevational view of an envelope inserting apparatus in accordance with the present invention; is FIG. 2 a perspective view of the inserting apparatus of FIG. 1 showing an envelope at an inserting station.
Figure 2:
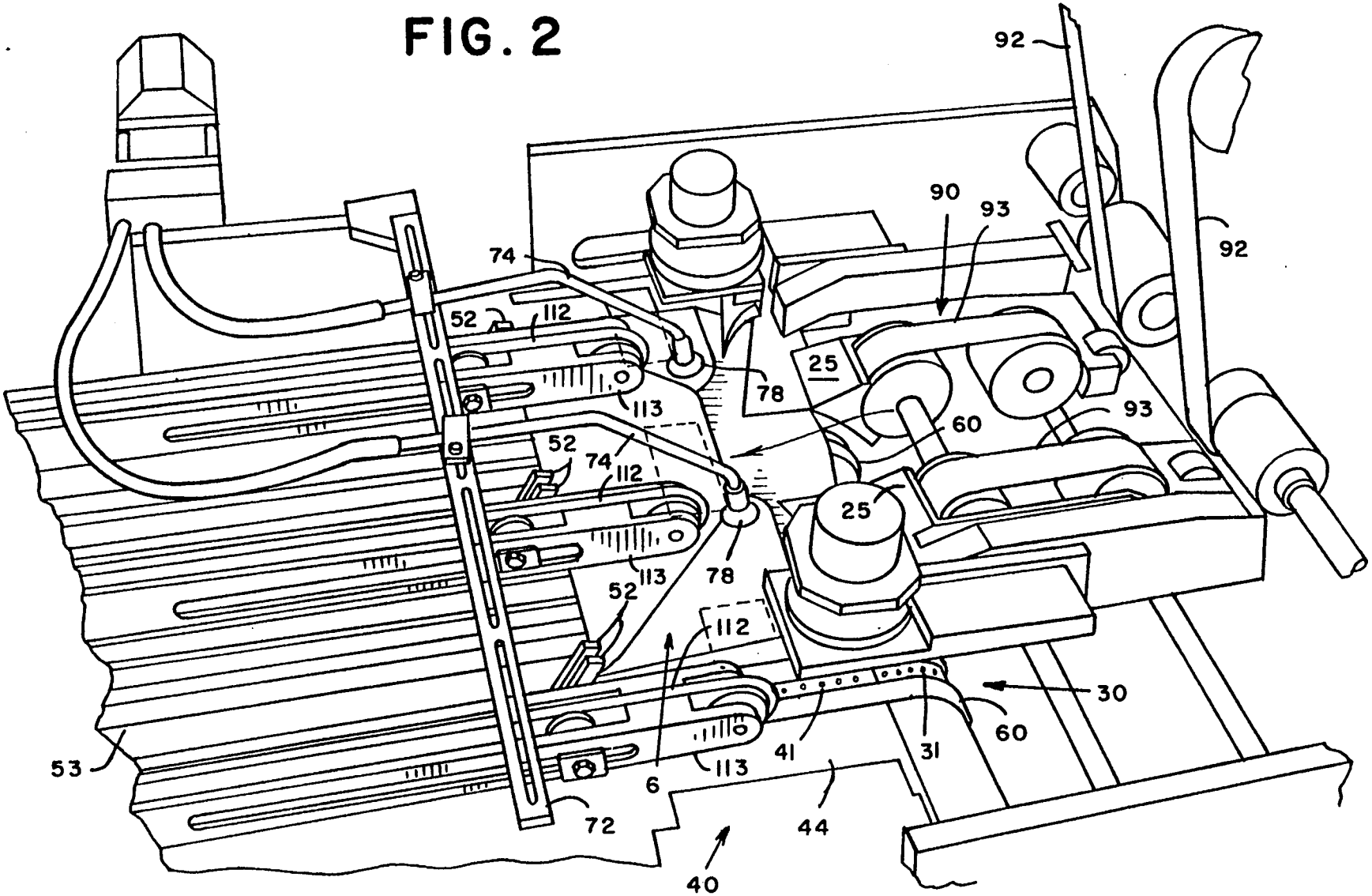
Figure 3:
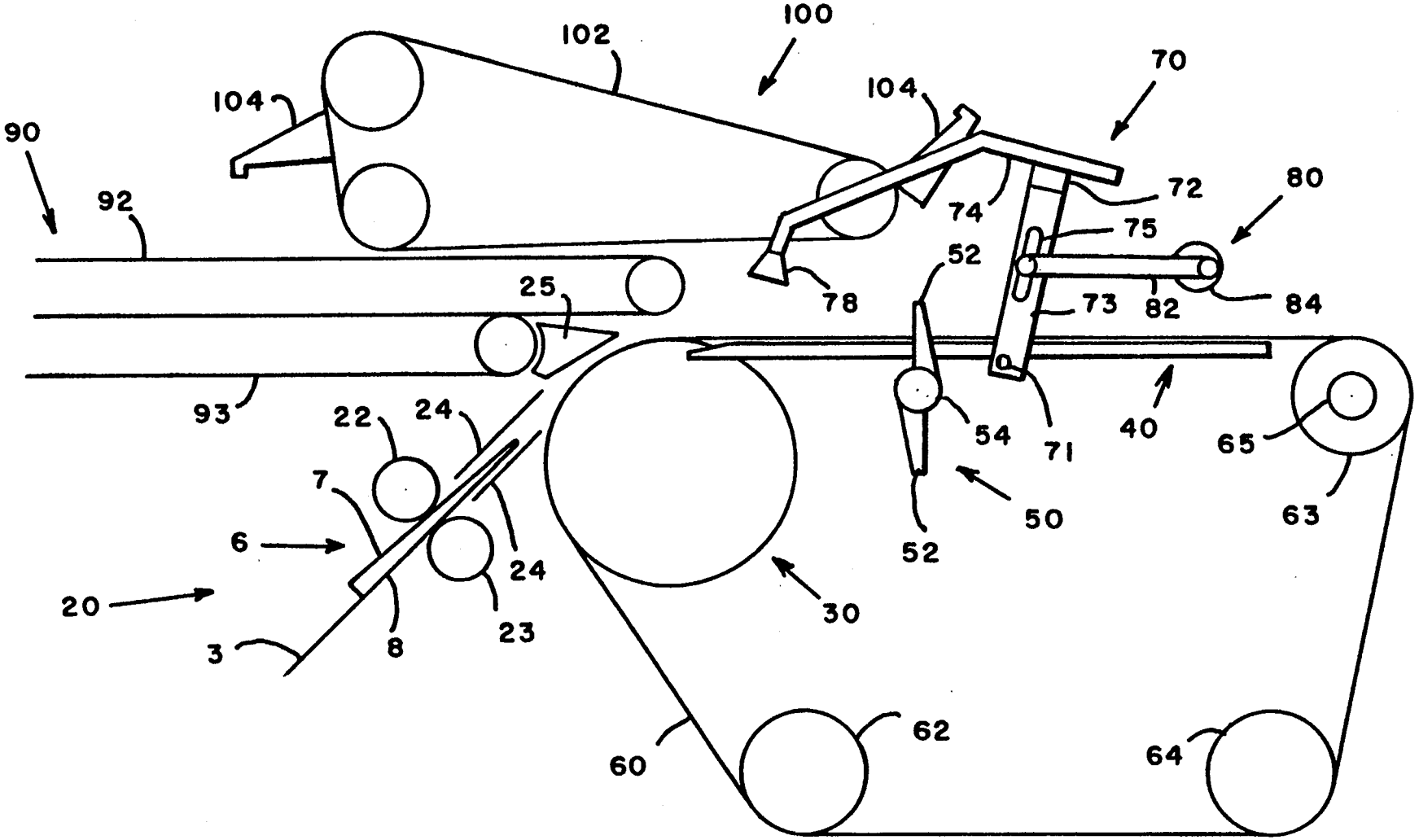
FIG. 3 schematic, side elevational view of the inserting apparatus of FIG. 1 with an envelope at the envelope staging station.

In describing the present invention, reference is made to the drawings, wherein there is seen in FIGS. 1-3 an envelope inserting station, generally designated 10, for an inserting machine. Inserting station 10 includes an envelope arming or staging area, generally designated 20, which consists of angled guide plates 24 and a series of laterally spaced roller pairs 22 and 23 that receive individual envelopes from a conventional envelope conveying device, such as an envelope feeder (not shown). Roller 23 is driven by a servo motor via conventional timing pulleys and belt (not shown).

Envelope inserting station 10 further includes a vacuum drum 30, which supplies valved, vacuum force to its periphery, and a plurality of laterally spaced transport belts 60 which move about the periphery of vacuum drum 30 and pulleys 62, 63, and 64. Vacuum drum includes a plurality of vacuum disks 32 (shown in FIGS. 18 and 19), each being straddled by a pair pulleys 34 on which transport belts 60 travel. Each of vacuum disks 32 provides a vacuum source to the surface of vacuum drum 30 through a series of holes 31 which are straddled by transport belts 60. In the preferred embodiment of the present invention there are five rows of vacuum disks 32 laterally spaced among ten pulleys 34 and transport belts 60. Vacuum is valved to the surface of drum 30 via a conventional valve assembly, such as an integral slide valve assembly or a solenoid valve assembly, (not shown) which opens/closes associated vacuum porting as a valve "piston" is laterally displaced along an axis of vacuum drum 30. Lateral displacement is provided by an eccentric cam (not shown) on the output shaft of a servo motor (not shown). It is noted that depending on the weight and size of the envelope being transported the vacuum may be valved continuously. A more detailed description of vacuum drum 30 is provided in the description of FIGS. 18 and 19.

Figure 18:
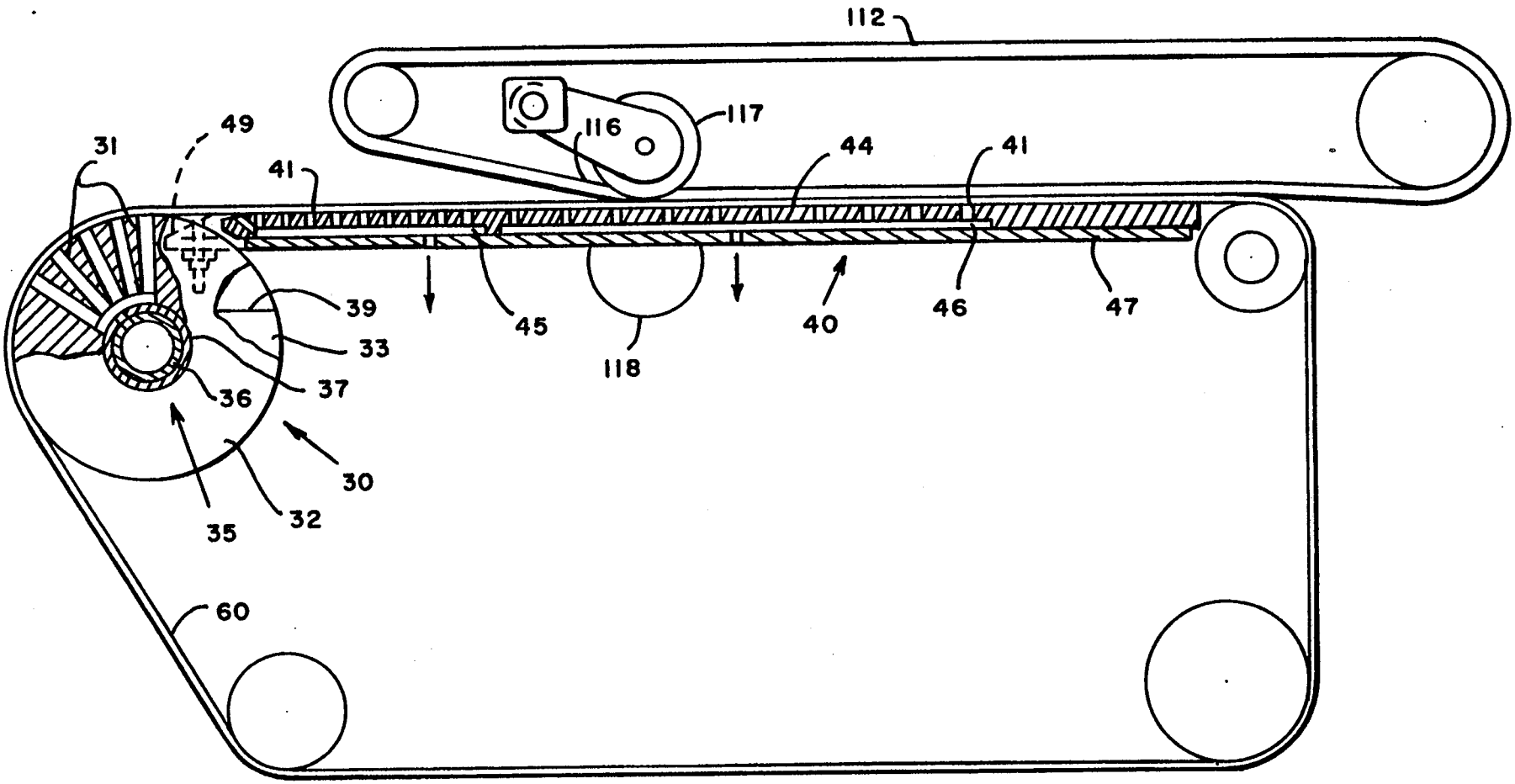
FIG. 18 is a side elevational view of the inserting apparatus of FIG. 2 taken along the lines 18—18.
Figure 19:
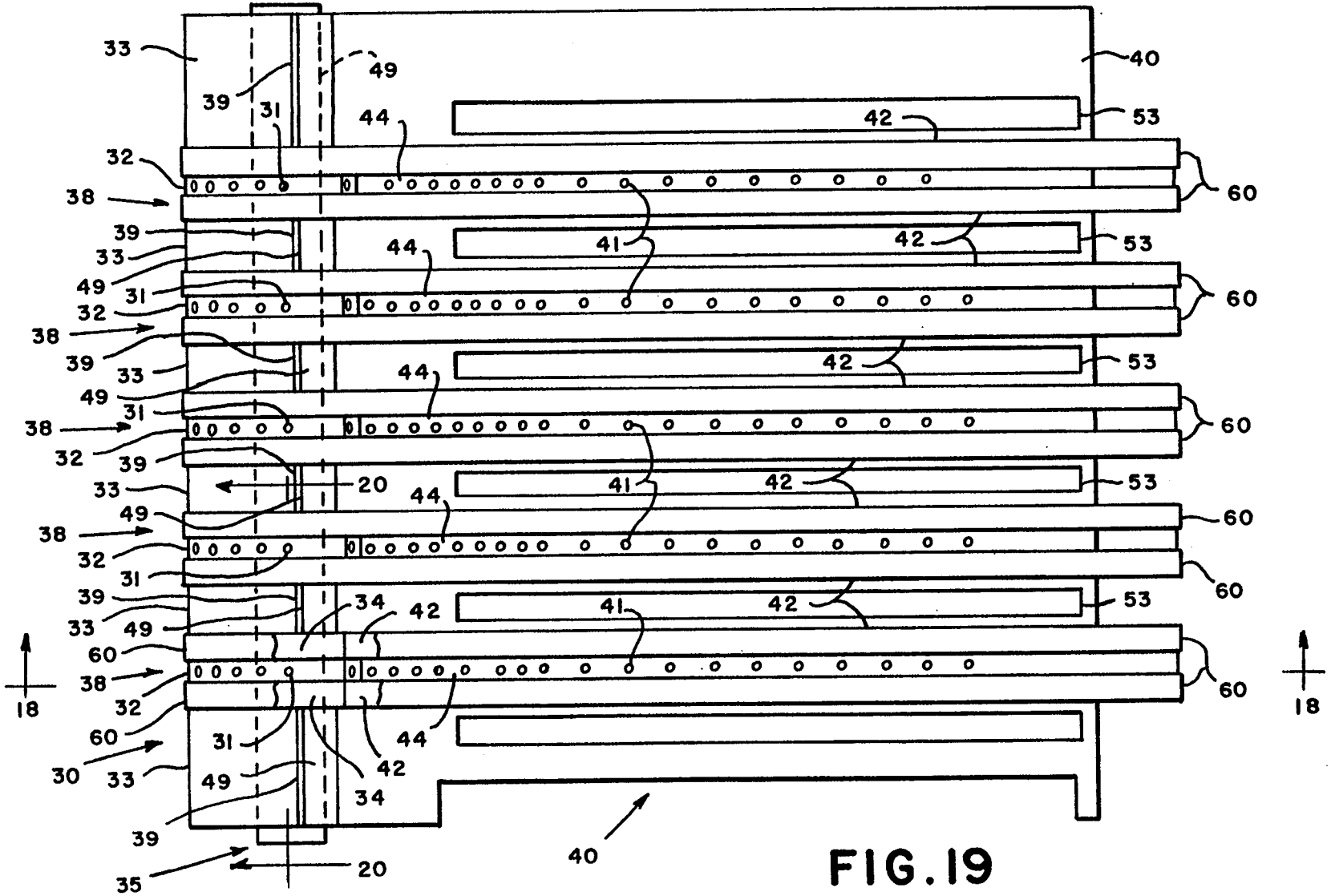
FIG. 19 is a top view of the vacuum deck and vacuum drum of the inserting apparatus of FIG. 18.

Envelope inserting station 10 also includes a vacuum deck 40 having a horizontal surface adjacent the top of vacuum drum 30 and containing a series of vacuum plenums (shown in FIGS. 18 and 19). Transport belts 60 are guided along the surface of vacuum deck 40 in specific grooves (not shown). Between each pair of transport belts 60 is an aperture which allows stop members of a backstop 50 to protrude above the surface of vacuum deck 40.

Transport belts 60 are a series of endless belts that travel around the periphery of vacuum drum 30 and pulleys 62, 63 and 64 and along the vacuum deck 40. Belts 60 are driven by pulleys 63 on shaft 65 which is located at the end of vacuum deck 40. Idler pulleys 62 and 64 that are located beneath vacuum drum 30 and vacuum deck 40. Shaft 65 is preferably driven by a servo motor (not shown). In the preferred embodiment of the present invention the motion of belts 60 is continuous for maintaining registration of envelope e against backstop 50. Continuous vacuum from vacuum deck 40 prevents any "jiggling" of envelope 6 even though belts 60 are in continuous motion.

Backstop 50 includes a series of laterally spaced "two-around" fingers 52 that protrude above the surface of vacuum deck 40 through slots (not shown) in the deck. Fingers 52 create a "wall" against which an incoming envelope will stop. All "two-around" fingers 52 are fixed to a single axle 54 located beneath vacuum deck 40 that spans the width of vacuum deck 40. As axle 54 spins the wall of fingers 52 disappears beneath deck 40 (at 90 degrees rotation) and then reappears (at 180 degrees rotation). The motion for this mechanism is provided by a servo motor (not shown) via conventional timing pulleys and belt. The entire mechanism is housed on a carriage (not shown) such that the position of backstop 50 can be adjusted toward vacuum drum 30 and away from vacuum drum 30 for handling a variety of envelope sizes. Envelope inserting station 10 further includes a vacuum bar assembly 70 located above vacuum deck 40. Assembly 70 includes a support bar 72 which spans the width of vacuum deck 40 and is rigidly secured at each end to a pair of pivotable arms 73 which rotate concentrically about a pivot point 71 located slightly under the plane of vacuum deck 40. Clamped to various locations along the width of support bar 72 are tubes 74 that are bent toward vacuum deck 40. Attached to the end of each tube 74 is a vacuum suction cup 78. As the entire vacuum bar assembly 70 is pivoted counterclockwise (as seen in the Figures), vacuum cups 78 descend toward deck 40 in such a manner as to contact the back panel 7 (shown in FIGS. 1 and 6) of the envelope 6 that has been transported against backstop 50. As vacuum bar assembly 40 pivots, vacuum is valved "on" and directed through tubes 74, causing vacuum cups 78 to "acquire" back panel 7 upon contact. Vacuum cups 78 pull up on back panel 7 when vacuum bar assembly 70 is pivoted clockwise about pivot point 71. The foregoing motion causes envelope 6 to open when front panel 8 of envelope 6 is held in place.

At the approximate middle (lengthwise) of one of the pivoting arms 73 is an end of a link 82 that extends back to a motor/crank assembly, generally designated as 80. Link 82 is connected to a slot 75 in the one pivoting arm 73 so that the stroke of motor/crank assembly 80 can be adjusted. Assembly 80 includes an eccentric crank 84 which drives vacuum bar assembly 70 and causes it to pivot back and forth about pivot point 71 to open envelope 6. Eccentric crank 84 is controlled by a servo motor (not shown) that drives a link 82 which is secured to one of pivoting arms 73. As eccentric crank 84 rotates, link 82 is driven back and forth causing the entire vacuum bar assembly 70 to rock forward to a position at which envelope back panel 7 can be acquired, and then backward causing envelope 6 to be opened. The servo motor is utilized in order to maintain positional control of the eccentric during the envelope opening cycle. The motion of vacuum bar assembly 70 allows vacuum cups 78 to translate downward to the surface of vacuum deck 40 and then upward away from vacuum deck 40 to a height that is sufficient for a stuffed envelope to pass therebetween. Integral to the motor/crank assembly 80 is a mechanical rotary vacuum valve (not shown) that regulates vacuum flow to vacuum cups 78.

Another component of envelope inserting station 10 is a dual belt transport 90 which includes two pairs of continuously moving, elastic transport belts 92 and 93 that accept and transport a collation 9 being conveyed from an upstream station in the insertion machine to inserting station 10. Transport 90 initiates the movement of the collation towards the envelope. After transport belts 92 and 93 have driven the collation a certain amount of distance toward the envelope over-head pusher fingers 104 seize control of the collation.

Envelope inserting station 10 further includes an overhead pusher assembly, generally designated 100, which consists of a series of laterally spaced belts 102. Each belt 102 has two pusher fingers 104 located approximately 180 degrees apart around the periphery of belts 102. Pushers 104 on belts 102 are aligned such that they create a "wall" that pushes collation 9 being conveyed by dual belt transport 90 into a waiting envelope. In FIG. 2, overhead pusher assembly is shown pivoted in an open position for accessibility to the paper path at inserting station 10.

Figure 14:
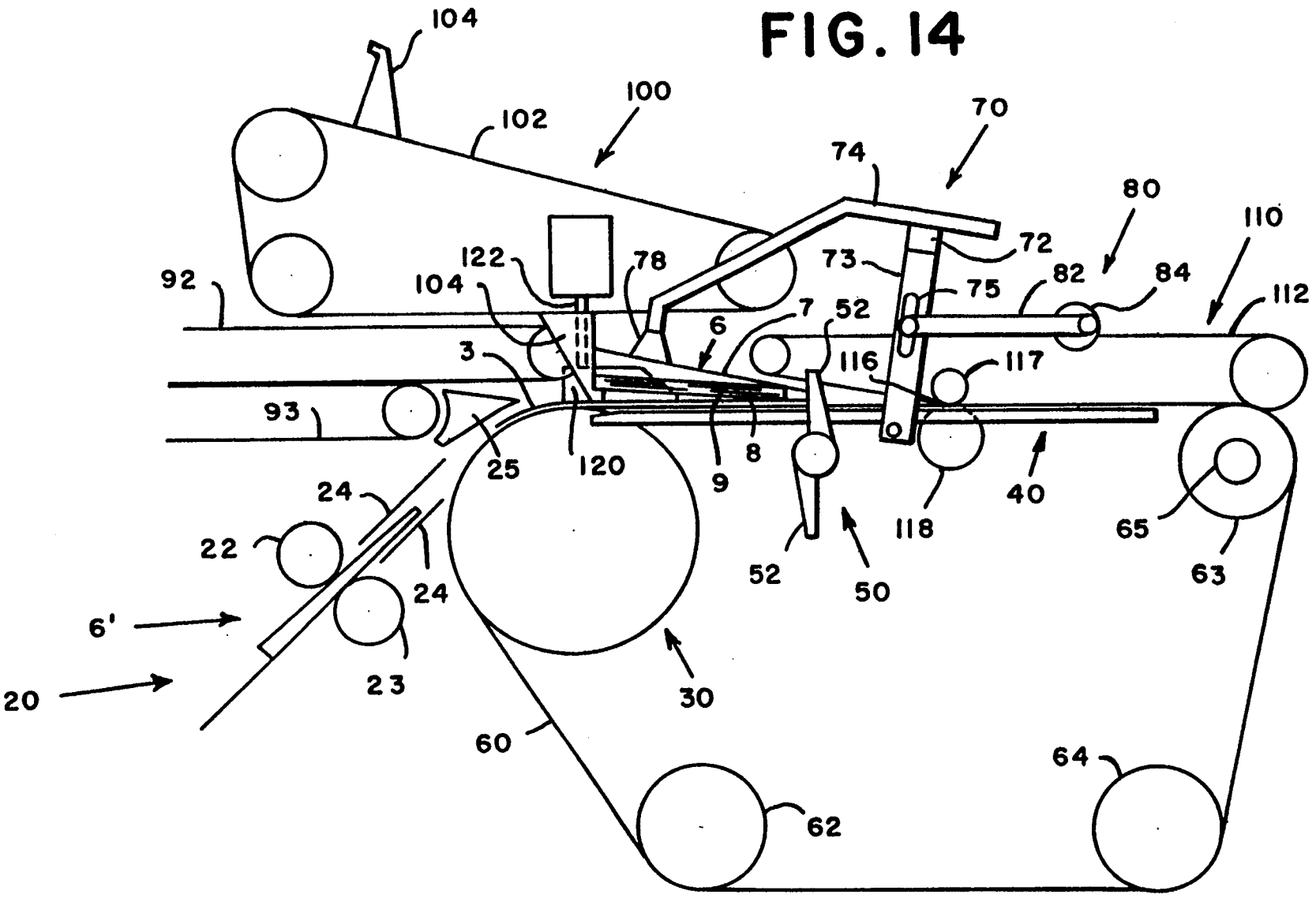
FIG. 14 is similar to FIG. 13 but shows the overhead pusher assembly continuing to push the collation which is substantially in the envelope.

Envelope inserting station 10 also includes an output belt assembly, generally designated 110, which extends from vertically above the insertion area to the most downstream portion of insertion device 10. Output belt assembly 110 includes a series of continuously running upper belts 112 that both interfere with fingers 52 of backstop 50 and mesh with transport belts 60. Fingers 52 include a groove through which the lower reach of corresponding belts 112 travel when fingers 52 are in an upright position. As shown in FIG. 2, the interference of the lower reach of belts 112 with corresponding ones of fingers 52 are obscured by belt support member 113. Such interference by belts 112 with fingers 52 provides a captivating area from which the envelope cannot escape as it is driven to backstop 50 from envelope staging area 20. The meshing of upper belts 112 with the transport belts 60 provides a positively controlled output transport for filled envelopes as they exit the insertion area. Integral to this is a nip 116 between upper idler rollers 117 through which upper belts 112 pass and lower driven rollers 118 which are located approximately two inches downstream of backstops 50 (FIG. 14). Each of idler rollers 117 have a center groove around its circumference which accepts one of belts 112. Idler rollers 117 are part of tension idler pulley assemblies that force belts 112 towards belts 60. Rollers 118 are driven at the same velocity as collation 9 moving into envelope 6. Once stuffed envelope 6 is in nip 116 of roller 117 and 188, the velocity of overhead pushers 104 is reduced to allow rollers 118 and 119 to take control of stuffed envelope 6. Rollers 117 and 118 transport the stuffed envelope 6 into the nip of belts 112 and 60 which complete the removal of stuffed envelope 6 from the insertion area. Lower rollers 118 are part of a backstop carriage assembly (not shown) and translates with the backstop carriage as it is adjusted for handling different sized envelopes. Upper idler rollers 117 are intended to translate with lower driven rollers 118 as this adjustment is made.

Finally, envelope inserting station 10 includes a pair of funnel shaped guide fingers or horns 120 that are pivoted into a waiting envelope 6 (at the extreme edges of the envelope) to shape and support the edges of the envelope for ease of collation entry. The horns are supported from above the envelope path and are eccentrically mounted on pivot shafts 122. They are positioned perpendicular to the path of envelope travel as the envelope is conveyed to backstop 50, and once the vacuum bar assembly 70 has begun to open the envelope, guide horns 120 pivot into the envelope and continue their pivoting motion until the extreme edges of the envelope have been shaped and supported by the horn profile. Rotating guide horns 120 perform the additional function of centering envelope 6 in the path of the oncoming collation 9. At this time collation 9 may be introduced and pushed through the guide horns 120 into envelope 6. The pivot shaft of each guide is driven by a servo motor 122. A more detailed description of the Rotating guide horns 120 is provided in U.S. Pat. application 08/037842, noted previously and incorporated herein by reference.

The flap 3 of the envelope is maintained in an flapped condition by envelope flap retainers 25 which, along with guide horns 120 and vacuum deck 40, maintain the lower envelope panel 8 and flap 3 in a position to receive collation 9 which is transported over flap 3.

In the preferred embodiment of the present invention closed-loop servo motors, commonly referred to as smart motors, are used to drive the driven components of inserting station 10. It will be understood that each of the servo motors could be selectively replaced by movements generated by cams, solenoids or a clutch-brake arrangements. An example of the servo motors used in the preferred embodiment of the present invention is any open or closed loop servo motor, such as the Sigmax II series of stepping motors manufactured by Pacific Scientific Motor and Control Division of Rockford, Ill.

The previously described mechanisms are the primary components of inserting station 10. The following description of the operation of inserting station 10 is made by referring to FIGS. 3 through 17. Although each mechanism component of inserting station is not shown in the Figures, the basic paper flows and mechanical relationships can be easily understood.

Referring now to FIG. 3, transport belts 60, dual belt transport 90 and upper output belts 112 are moving continuously. Vacuum is continually present at vacuum drum 30 and vacuum deck 40. An envelope 6 is being held at envelope staging area 20 in the nip between rollers 22 and 23. Backstop 50 is in a stop position. Vacuum bar assembly 70 is in a raised position without vacuum.

Figure 4:
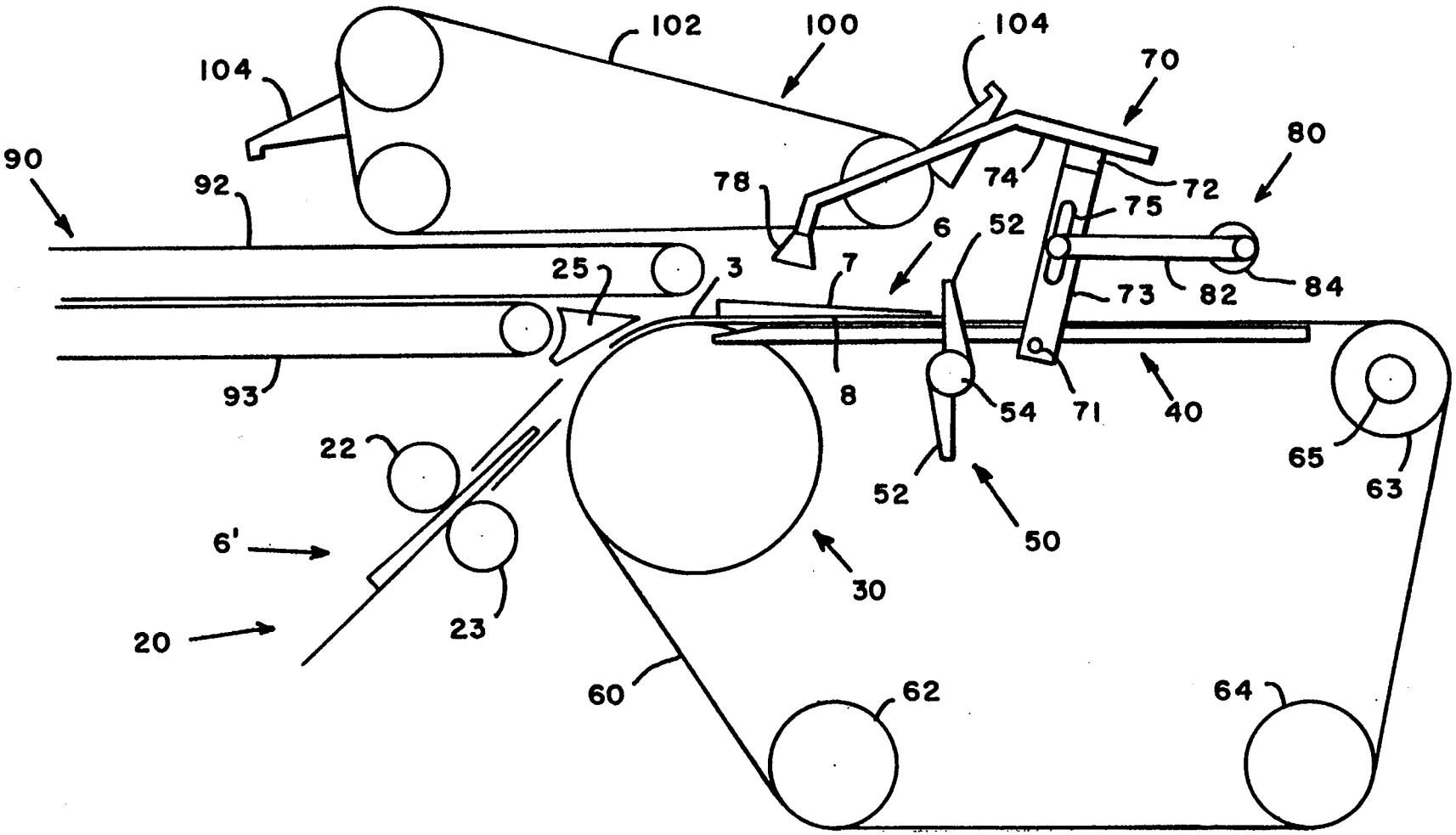
FIG. 4 is similar to FIG. 3 but shows the envelope being transported to the inserting station with sucker bar assembly and backstop in the home position.

Referring now to FIG. 4, envelope 6 has been transported toward the insertion area by rollers 22 and 23. Envelope 6 is urged against moving transport belts 60 by the vacuum of vacuum drum 30 causing envelope 6 to move around the periphery of vacuum drum 30. The continuous vacuum from vacuum deck 40 assists belts 60 drive the envelope to backstop 50. At this point, envelope 6' is forwarded to envelope staging area 20.

Figure 5:
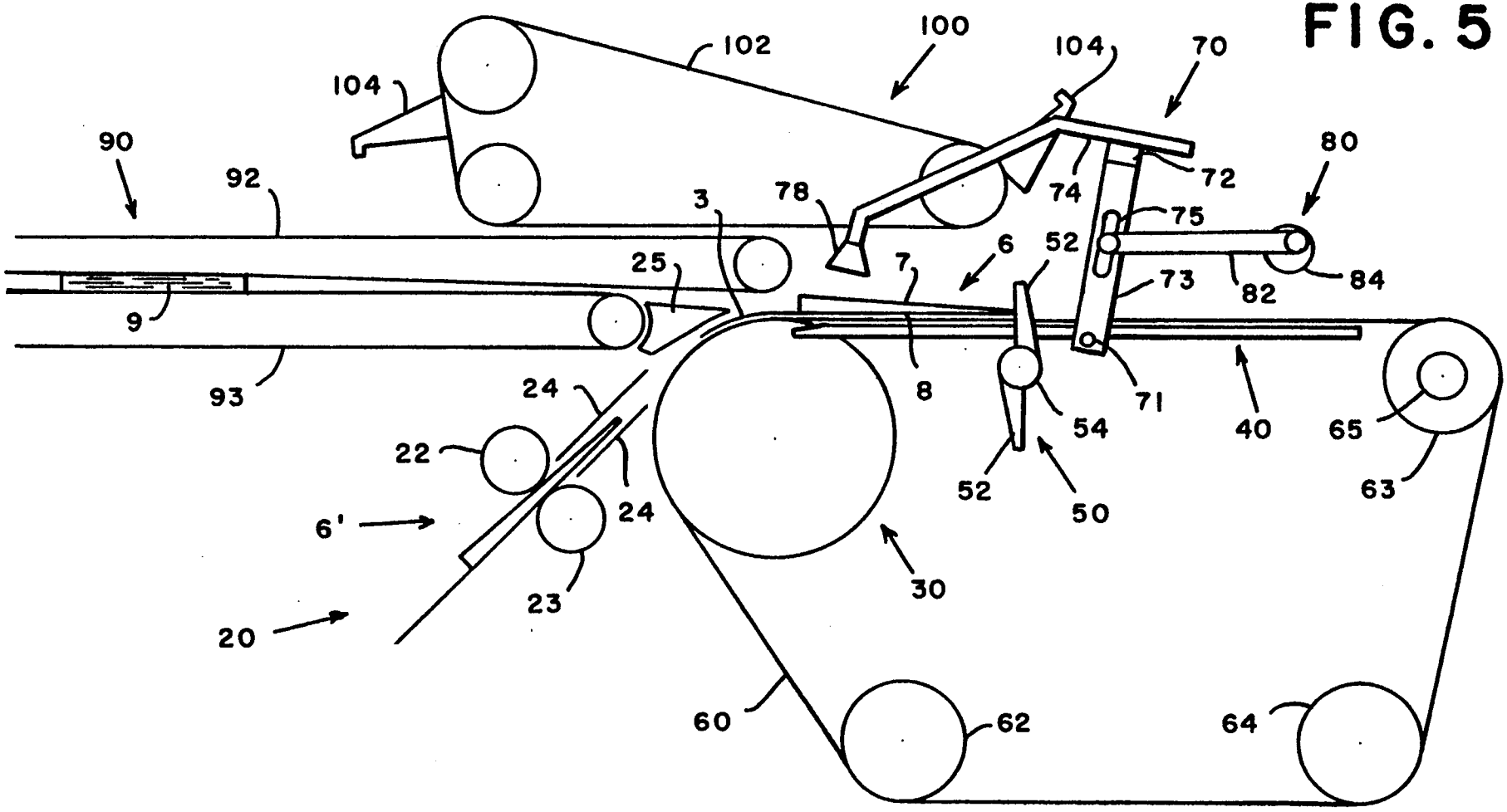
FIG. 5 is similar to FIG. 4 but shows the envelope stopped against the backstop, the sucker bar assembly beginning descent, and a collation of enclosures approaching the inserting station.
Figure 6:
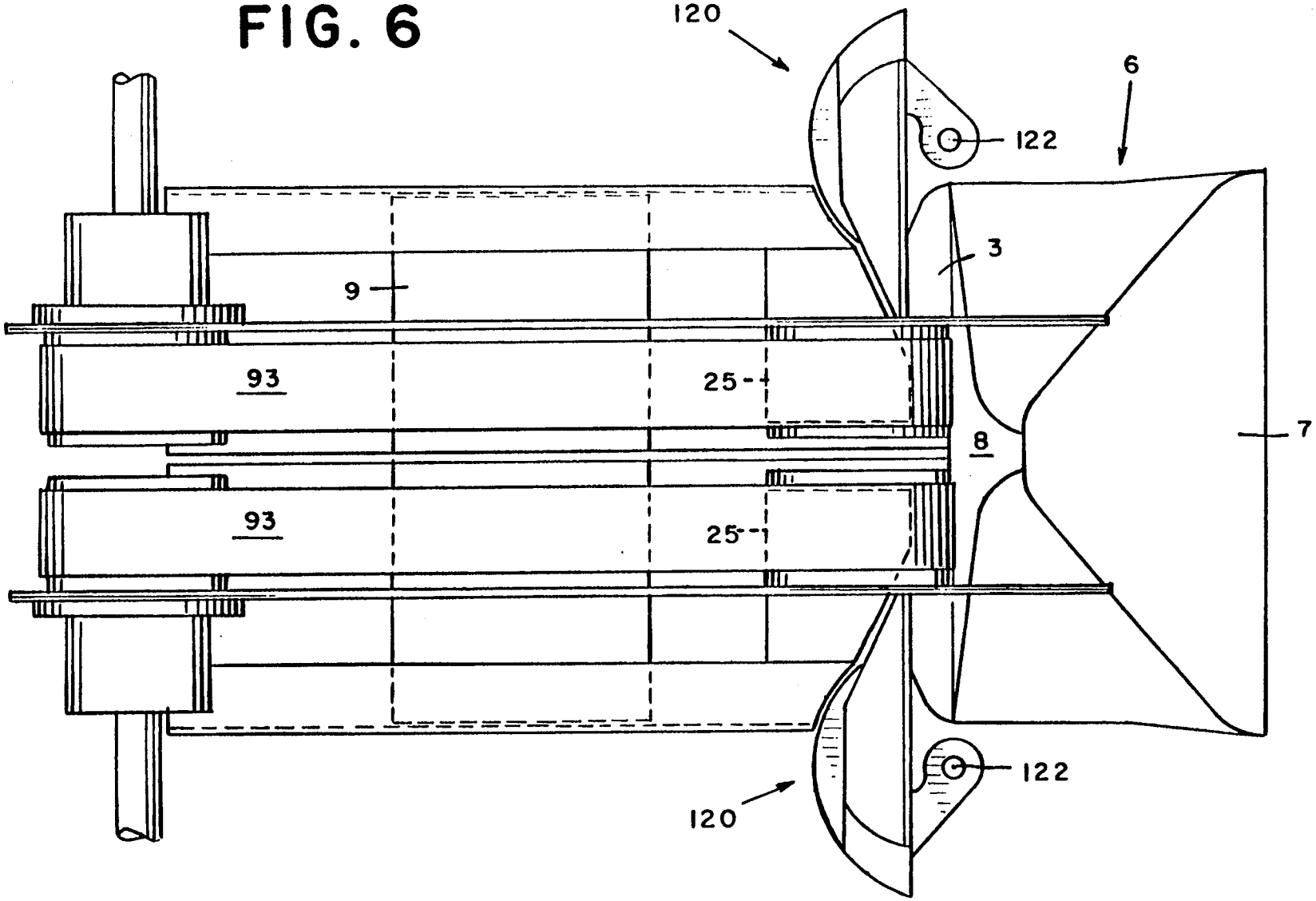
FIG. 6 is a top view of the apparatus of FIG. 5 showing the position of the pivoting guide horns in a retracted position.

Referring now to FIG. 5, envelope 6 is stopped against backstop 50. The continuous vacuum from vacuum deck 40 and the continuous movement by belts 60 keep envelope 6 deskewed against backstop 50. The vacuum from vacuum deck 40 prevents envelope from jiggling from the continuous movement by belts 60. No damage occurs to the envelope because of the inherent stiffness in the envelope and the fact that the vacuum is between belts 60, i.e., non-positive drive. The vacuum bar assembly 70 has begun its descent. Collation 9 is being transported by dual belt transport 90 toward envelope 6. Guide horns 120, as shown in FIG. 6, are in a retracted position which is 90° to the paper path.

Figure 7:
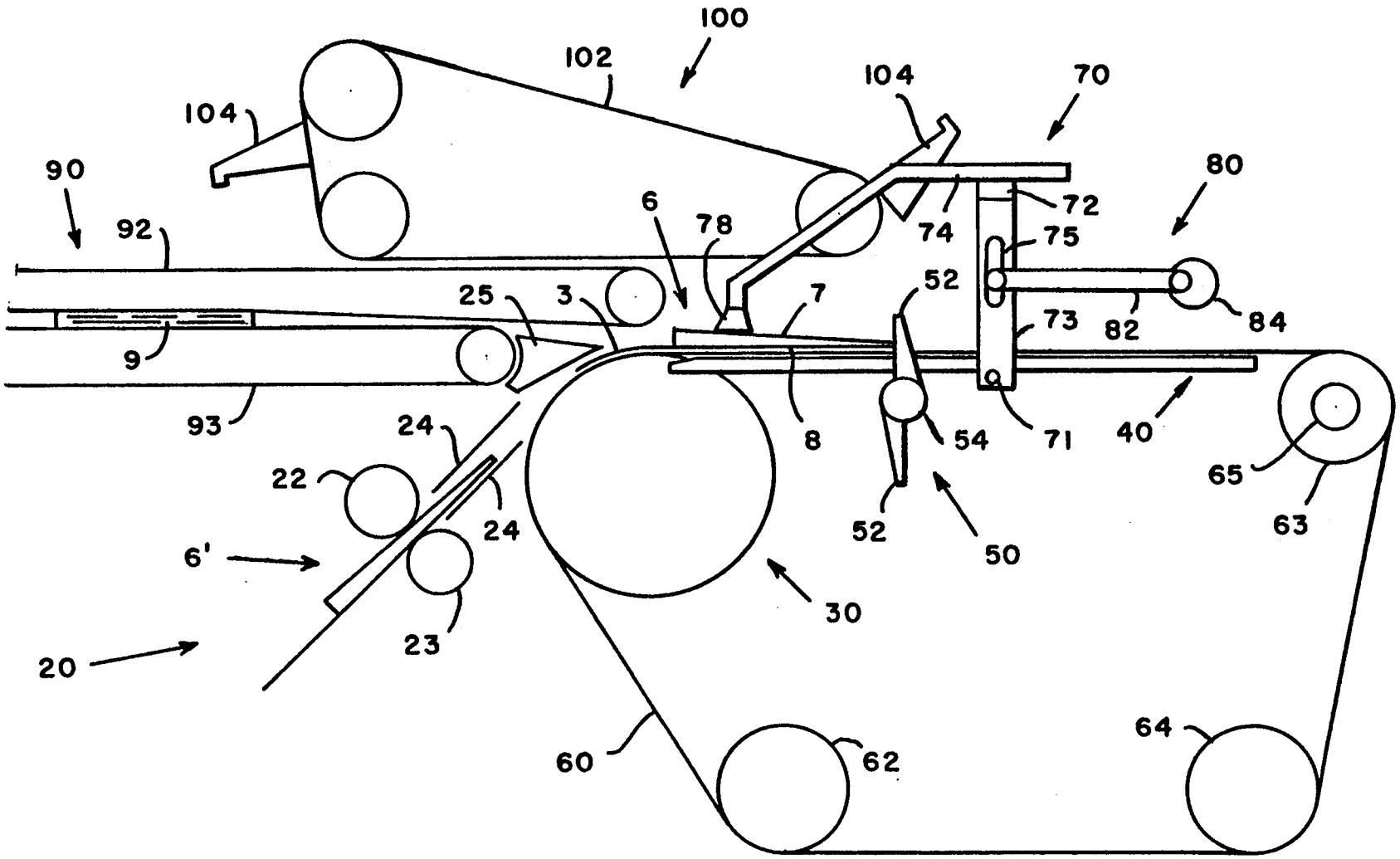
FIG. 7 is similar to FIG. 5 but shows the sucker bar assembly rotating into contact with the envelope and the collation closer to the inserting station.

Referring now to FIG. 7, vacuum cups 78 have made contact with top envelope panel 7 as vacuum is valved on. Dual belt transport continues to drive collation 9 toward envelope 6 at the insertion area.

Figure 8:
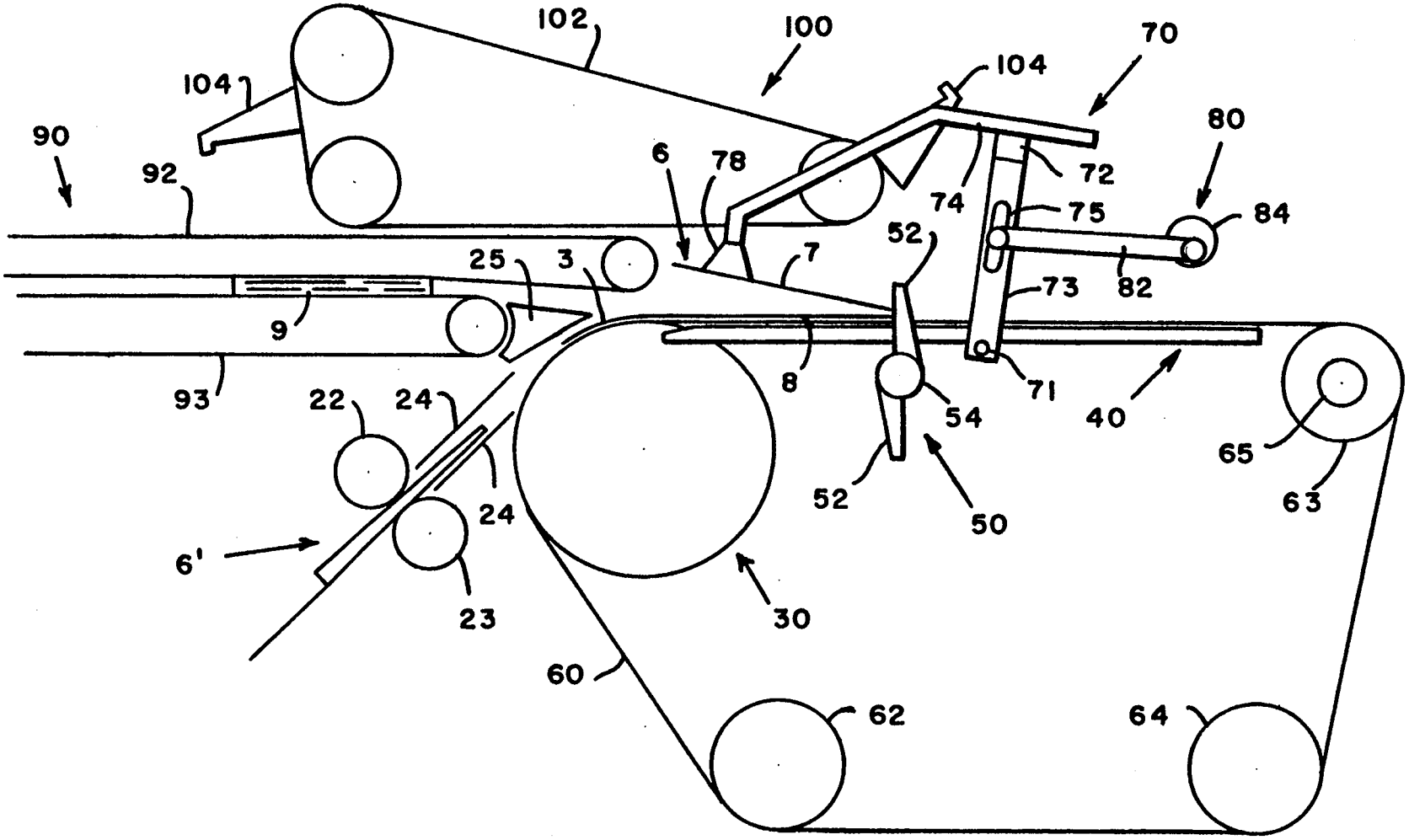
FIG. 8 is similar to FIG. 7 but shows the sucker bar assembly rotated to its maximum ascended position with the envelope fully opened, and the collation closer to the inserting station.
Figure 9:
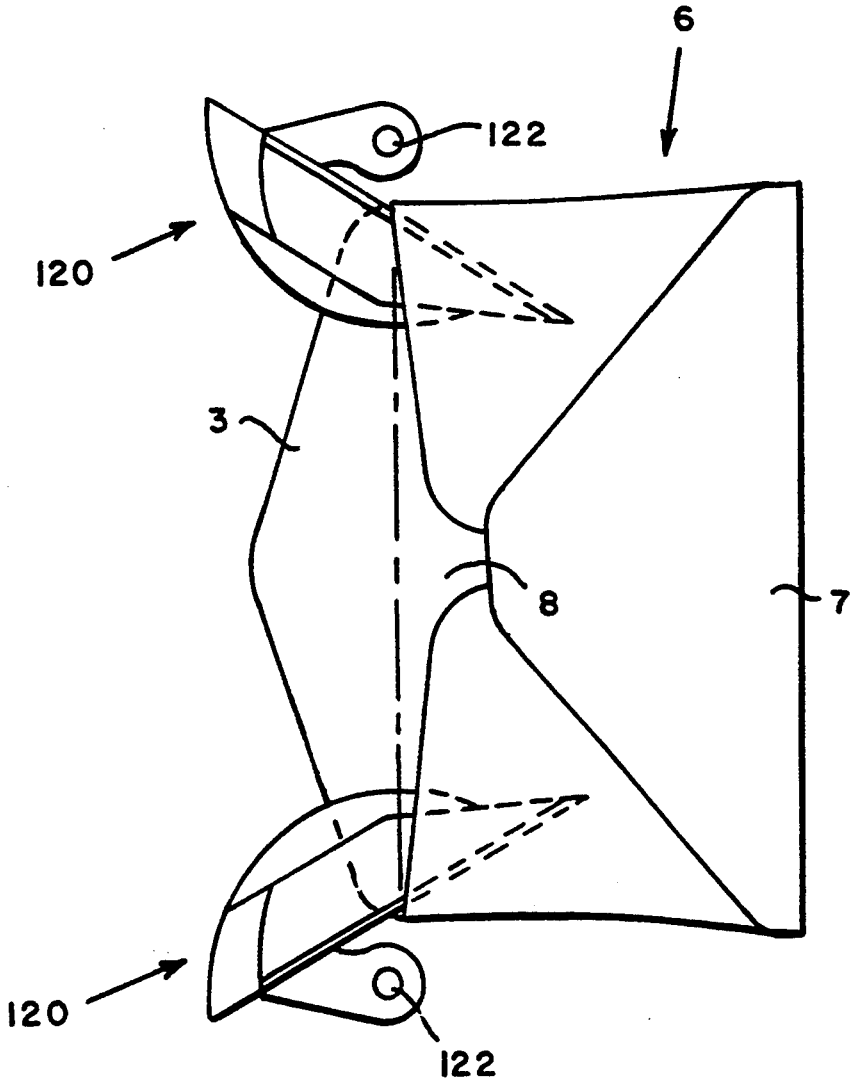
FIG. 9 is a top view of the apparatus in FIG. 8 showing the partially pivoted position of the pivoting guide horns.

Referring now to FIG. 8, vacuum bar assembly 70 has begun to open envelope 6. Continuous vacuum to vacuum deck 40 holds lower envelope panel 8 against deck 40. The envelope flap 3 is held down by flap guide 25. Dual belt transport 90 continues to drive collation 9 toward envelope 6 at the insertion area. Guide horns 120 are pivoting into the opening of envelope 6 as shown in FIG. 9.

Figure 10:
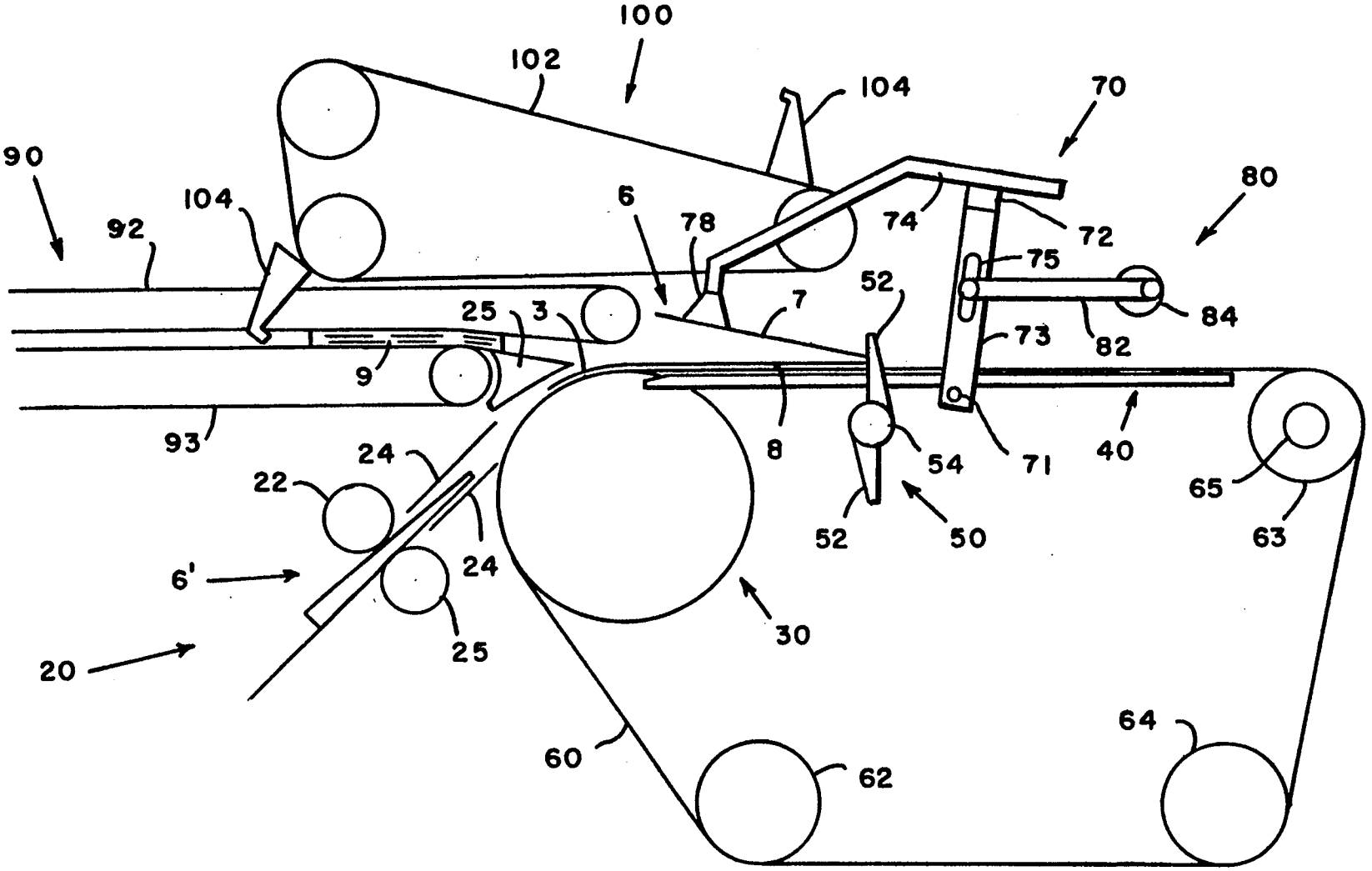
FIG. 10 is similar to FIG. 8 but shows overhead pusher assembly accelerating to catch up with trailing edge of the collation.
Figure 11:
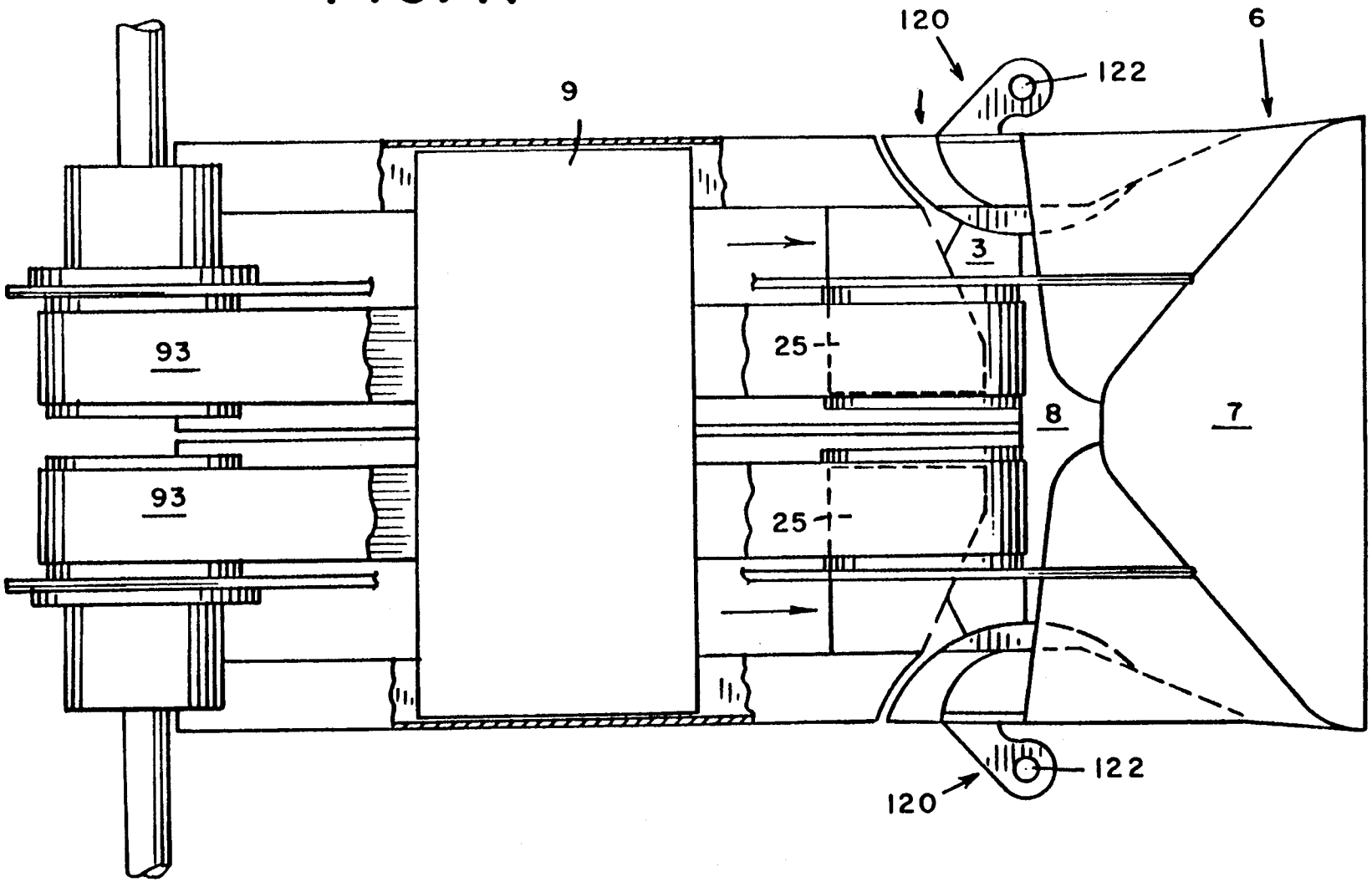
FIG. 11 is a top view of the apparatus in FIG. 10 showing pivoting guide horns completely in the envelope.

Referring now to FIG. 10, vacuum bar assembly 70 has completed its ascent and envelope 6 is fully opened. Pusher fingers 104 begin to accelerate as collation 9 is driven closer toward envelope 6 by dual belt transport 90. Guide horns 120 are completely into the opening of envelope 6 as shown in FIG. 11.

Figure 12:
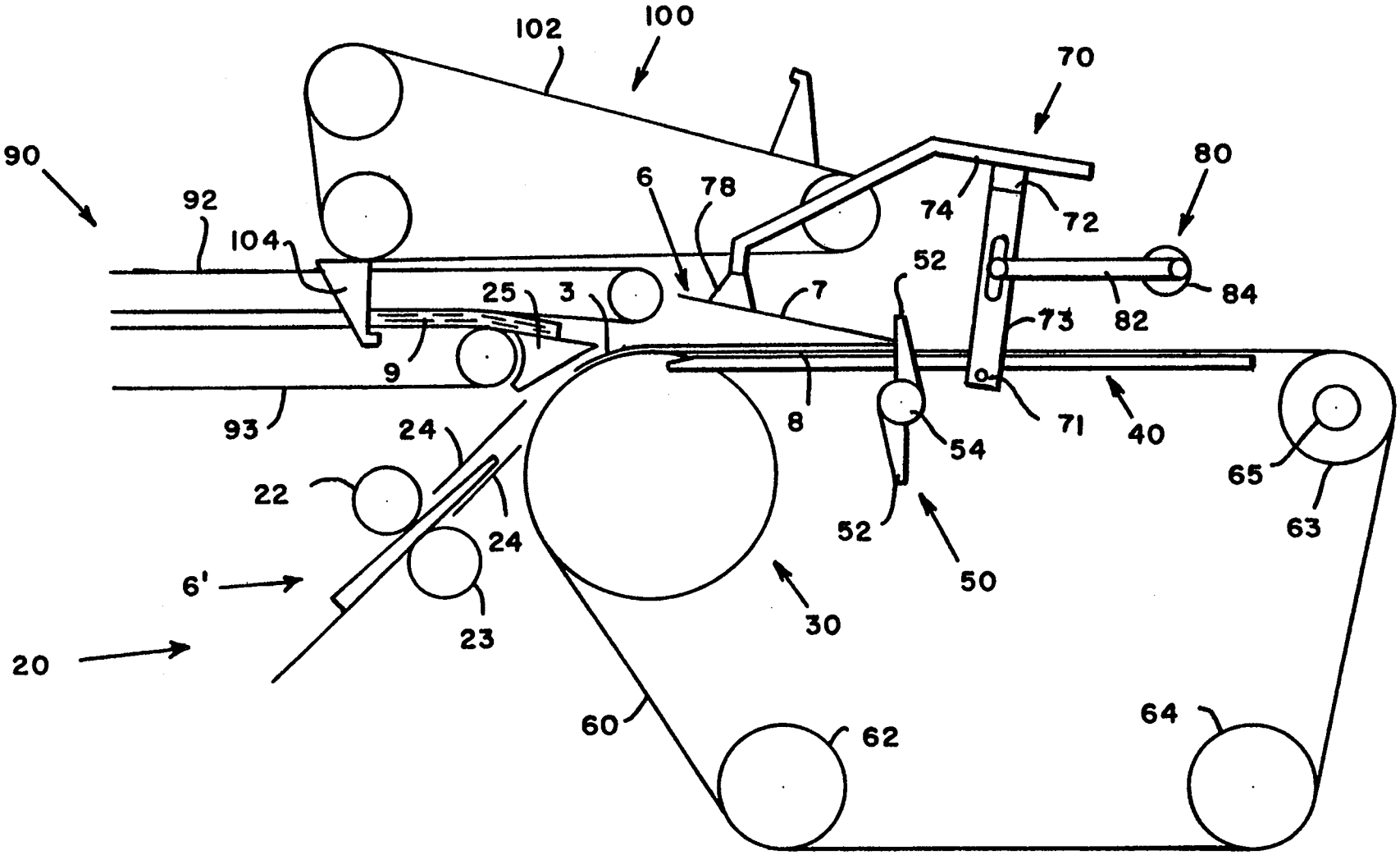
FIG. 12 is similar to FIG. 10 but shows overhead pusher assembly engaging the trailing edge of the collation.
Figure 13:
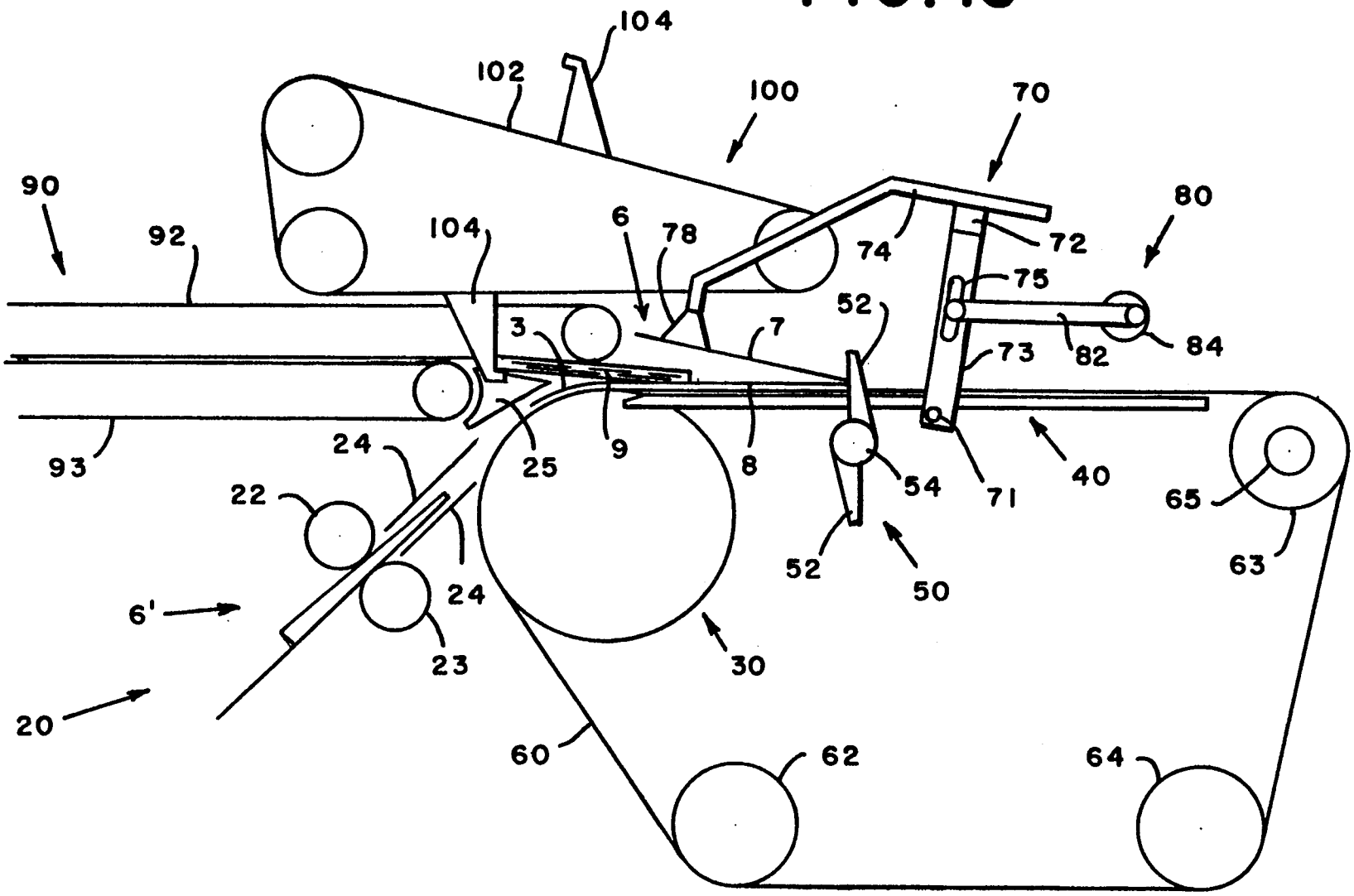
FIG. 13 is similar to FIG. 11 but shows the collation being pushed into the envelope by the overhead pusher assembly.

Referring now to FIG. 12, pusher fingers 104 have caught up to the trailing edge of collation 9 as it came out of dual belt transport 90. In FIG. 13, pusher fingers 104 push collation 9 into envelope 6.

Figure 15:
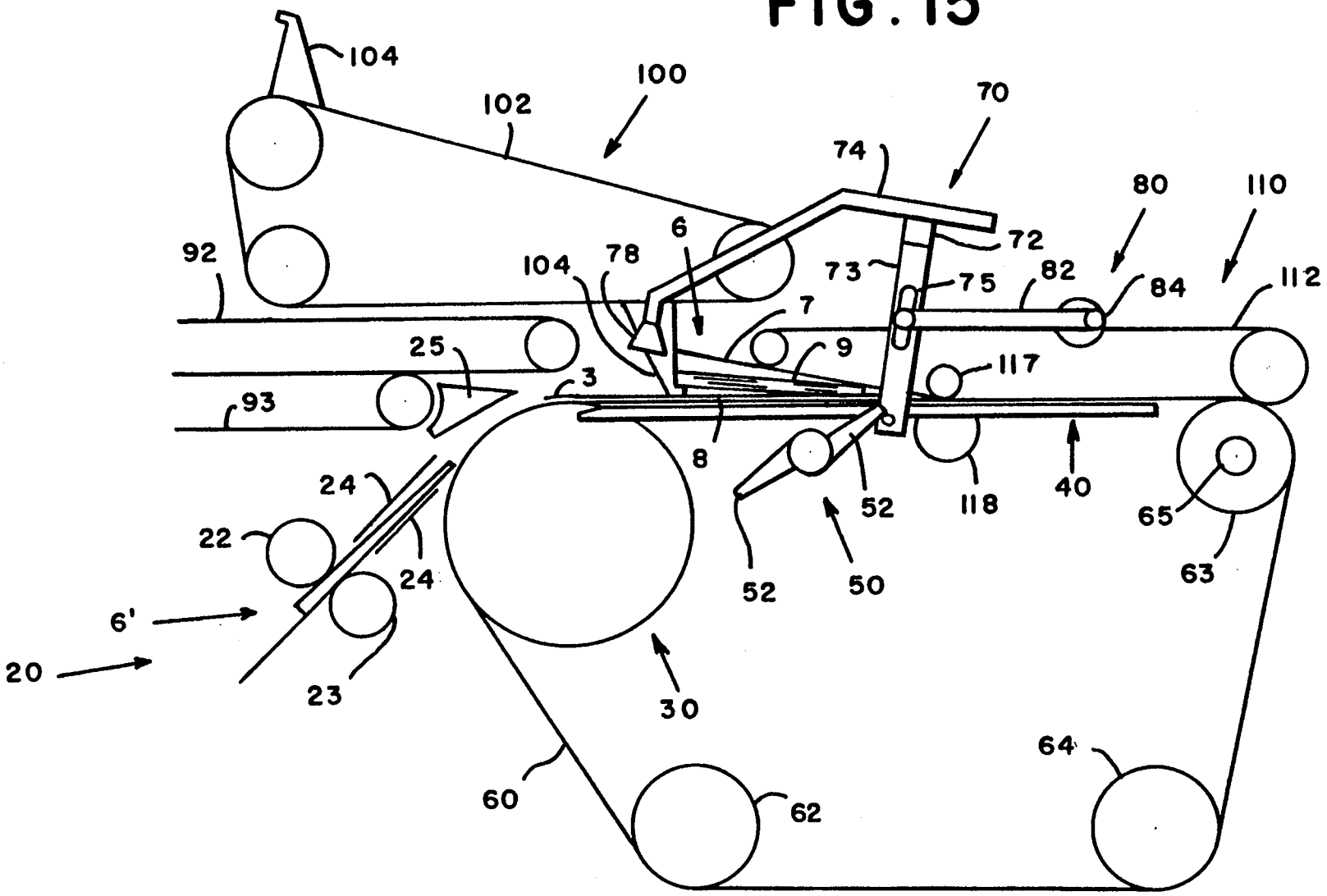
FIG. 15 is similar to FIG. 14 but shows the backstop pivoting clockwise out of the paper path and the overhead pusher assembly the pushing the stuffed envelope toward an output transport.

Referring now to FIG. 14, collation 9 has been pushed substantially into envelope by pusher fingers 104. Vacuum is released from vacuum cups 78. Backstop 50 begins to pivot (clockwise) out the way. Depending on the shape of the throat of envelope 6, either pusher fingers 104 hit the throat of envelope 6 and push envelope 6 toward output transport belts 112, or the momentum of collation 9 causes envelope 6 to move toward output transport belts 112 when collation 9 hits the bottom of envelope 6. Envelope 6' begins accelerating out of staging area 20 toward vacuum drum 30. Using overhead pusher fingers 104 to push the envelope out of the insertion area ensures that collation 9 is pushed to the bottom of envelope 6 and beyond the flap crease line. The velocity of overhead pushers 104 is matched to the velocity of transport belts 60 and backstops 50 are dropped at a precise time so that pushers 104 do not crash into the envelope. FIG. 15 shows envelope 6 leaving the insertion area.

Figure 16:
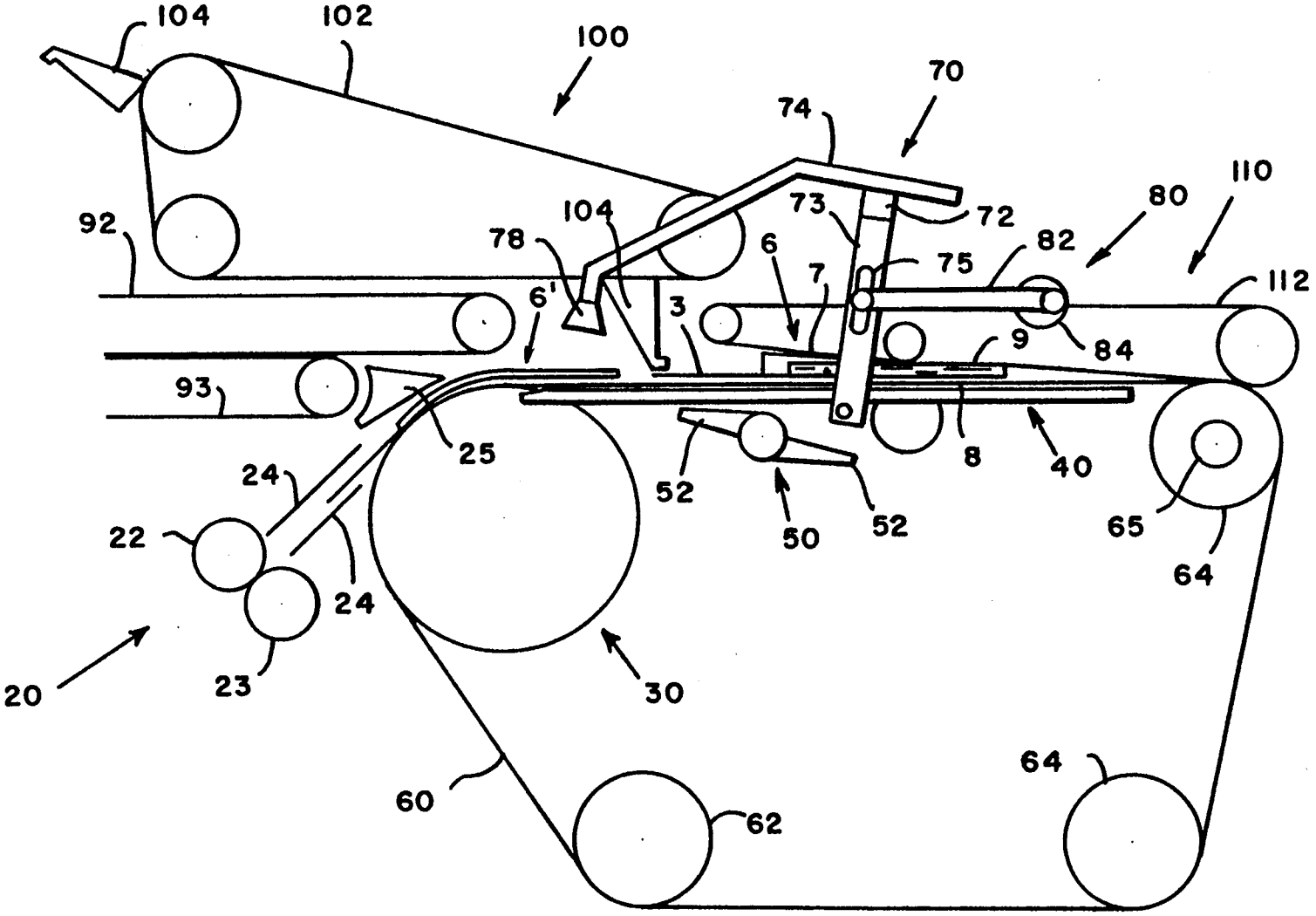
FIG. 16 is similar to FIG. 15 but shows the backstop pivoted completely out of the paper path and the stuffed envelope in the output transport.

Referring now to FIG. 16, backstop 50 has pivoted completely out of the paper path. Rollers 117 and 118 have taken control of envelope 6 and move envelope 6 into output transport 120. Envelope 6' is driven by transport belts 60 over vacuum drum 30 and vacuum deck 40 to backstop 50. Pusher fingers 104 decelerate to wait for clearance with envelope 6 before returning to a home position. Backstop 50 is waiting for envelope 6 to exit before pivoting further to a vertical "stop" position. If desired to maximize throughput of insertion station 10, backstop 50 has the capability of rotating to the vertical "stop" position before the flap of envelope 6 has exited. Backstop 50 will merely displace the flap of envelope 6 upward before envelope 6 has completed its exit. Also guide horns 120 have begun to rotate back to a retracted position perpendicular to the paper path.

Figure 17:
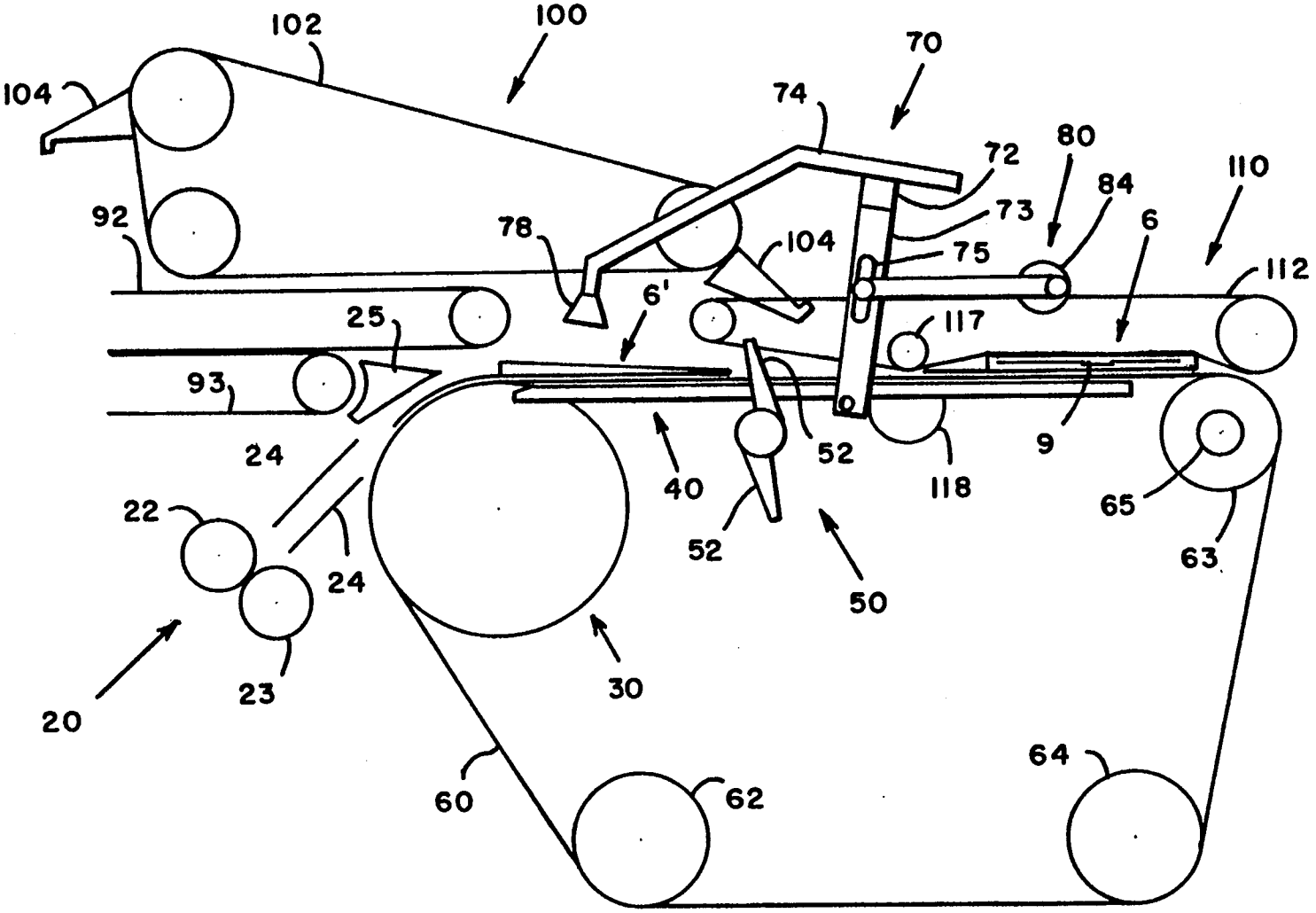
FIG. 17 is similar to FIG. 16 but shows the envelope exiting via the output transport, the backstop continuing to pivot to the home position, and a second envelope being transported to the inserting station.

Referring now to FIG. 17, envelope 6' is exiting via output belt assembly 110. Envelope 6' has been transported toward the insertion area by rollers 22 and 23. Vacuum drum 30 has urged envelope 6' against transport belts 60 to drive envelope 6' toward backstop 50. The continuous vacuum from vacuum deck 40 assists belts 60 drive the envelope to backstop 50. Backstop 50 is pivoting to a stop position.

From this point, the system cycles continuously from FIG. 5.

Figure 20:
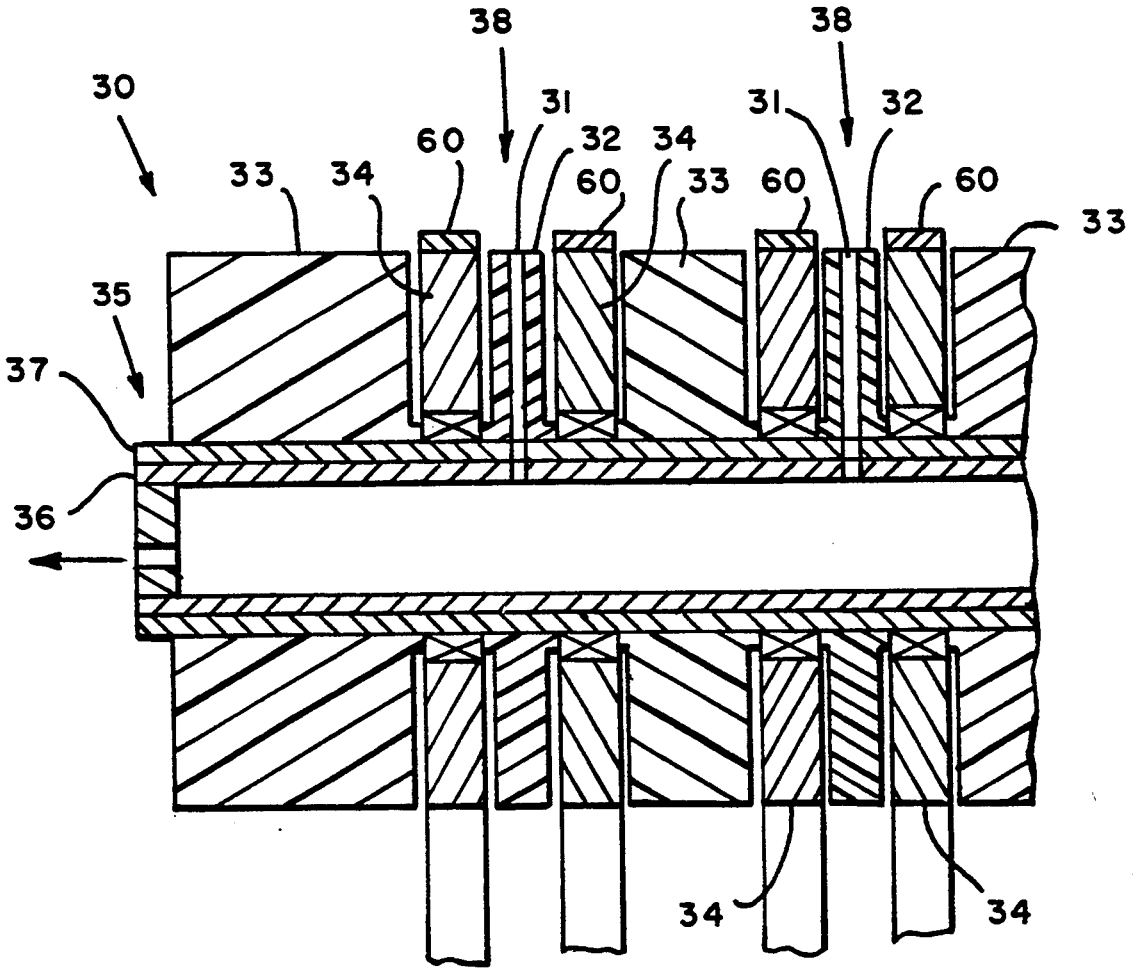
FIG. 20 is a front sectional view of the inserting apparatus of FIG. 19 taken along the lines 20—20.

Referring now to FIGS. 18–20, the configuration of vacuum drum 30, vacuum deck 40 and transport belts 60 is shown in more detail. Vacuum drum 30 is actually a series of individual segments of vacuum disks 32, solid disks 33 and pulleys 34 that are mounted on a shaft 35. Shaft 35 is a round plenum for vacuum drum 30 comprising an inner tube 36 and outer tube 37 and a conventional valve assembly (not shown). Pulleys 34 are conventional timing pulleys that freely rotate on outer tube 37 of shaft 35 while supporting transport belts 60 which are continuously moving timing belts. Vacuum disks 32 and solid disks 33 are fixed to outer tube 37. In the preferred embodiment, there are five drum groups 38 of individual segments arranged in the order of a vacuum disk 32 straddled by a pair of pulleys 34. (FIG. 20 provides a sectional view of one of drum groups 38.) There is a solid disk 33 between each group and at each end of vacuum drum 30.

Pulleys 34, vacuum disks 32 and solid disks 33 are sized to avoid moving envelope 6 though too sharp of a turn. In the preferred embodiment of the present invention, they have a diameter of approximately three inches. Since vacuum disks 32 and solid disks 33 do not rotate, each disk includes a hub that has a slightly greater width than the disk itself so that pulleys 34 freely rotate in the assembled vacuum drum 30. Vacuum disks 32 and solid disks 33 must have a good wear surface and low coefficient of friction. In the preferred embodiment of the present invention, vacuum disks 32 and solid disks 33 are made from a high density polyethylene.

Vacuum disks 32 are provided with a plurality of radial vacuum holes 31 (a minimum of five) that are located in the top quarter section of vacuum disks 32 that is between envelope staging section 20 and the beginning of vacuum deck 40. Holes 31 are all connected to corresponding holes in outer tube 37 which is part of a round plenum including inner tube 36.

Pulleys 34 support belts 60 which are continuously moving over part of the periphery of vacuum drum 30 that contains vacuum holes 31. The relative diameters of pulleys 34, solid disks 33 and vacuum disks 32 are such that the surface of belts 60 on pulleys 34 is slightly higher than the outer surface of solid disks 33 and vacuum disks 32. In this manner, an envelope is urged against belts 40 but does not necessarily make contact with disks 32 or solid disks 33. Although the present invention uses the vacuum drum and belt arrangement to transport envelopes being conveyed in one direction to another direction, it will be appreciated that this arrangement can also be used to transport single sheets as well.

Vacuum deck 40 includes an upper deck member 44 which has ten longitudinal grooves 42 formed therein. Each of grooves 42 is effectively a horizontal continuation of one of pulleys 34 and accommodates one of belts 60 in its course of travel. Between each pair of grooves 42 a plurality of vacuum holes 41 in upper deck member 44 function as inlet ports for a pair of plenums 45 and 46. Front plenum 45 and rear plenum 46 are comprised of cavities between lower plenum member 47 and upper deck member 44. Front and rear plenums 45 and 46 are used in the preferred embodiment of the present invention to provide more flexibility in controlling an envelope. Upper deck member 44 must have a good wear surface, such as Delrin TM. In the preferred embodiment, holes 41 in front plenum 45 are more closely space to provide for better handling of smaller sized envelopes. Plenums 45 and 46 are effectively a continuation of the vacuum disks 32 that are between pairs of pulleys 34 in vacuum drum 30. Each of plenums 45 and 46 has its own source of vacuum so that the vacuum can be separately valved at each plenum. Thus, there are ten plenums, five front and five rear, and ten vacuum supplies in vacuum deck 40. In the preferred embodiment, electronic valve control (not shown) is used to control vacuum to plenums 45 and 46. Although vacuum is continually present in vacuum deck 40, as previously described, vacuum is not desired in plenums that are not controlling and envelope. For example, as shown in FIG. 2 envelope 6 is not under the control of the nearest pair of timing belts 60 and deck member 44. Therefore, the vacuum supply for front and rear plenums corresponding to this deck member 44 would be valved off.

Between each group of deck member and pair of belts 60 is a longitudinal slot 53 through which backstop fingers 52 extend and rotate. The length of slots 53 is suitable for the rotation of fingers 52 from various positions that backstop 50 may be adjusted for handling a particular envelope size as previously described. The surface of vacuum deck 40 at vacuum holes 41 and slots 53 is slightly lower than the surface of belts 40 moving through grooves 42. In this manner, an envelope is urged against moving belts 40 but does not necessarily make contact with vacuum deck 40.

As Seen in FIGS. 1, 18 and 19, each of solid disks 33 includes a cut out 39 that accepts an extended portion 49 of vacuum deck 40 that is tapered downward. This arrangement allows vacuum disks 32 and pulleys 34 to extend into the beginning of vacuum deck 40 to prevent the lead edge of an envelope from hitting the front end of vacuum deck 40.

In operation, as an envelope is conveyed from envelope staging section 20, the vacuum at vacuum holes 31 in vacuum drum 30 urge the envelope against the belts 40 which are continuously moving on pulleys 34. The envelope follows belts 40 around part of the periphery of vacuum drum 30 to vacuum deck 40. The vacuum at vacuum hole 41 in vacuum deck 40 urge the envelope against belts 40, which transport the envelope to backstop 50.

In accordance with the present invention, throughput is increased by having the "next" envelope waiting at the envelope arming station in close proximity to the inserting area and the transporting the next envelope to the insertion area as a stuffed envelope is being removed from the inserting area.

By using the non-positive drive, vacuum and belt arrangement of the present invention, the envelope transport can operate continuously and thus eliminates delays typically associated with feeding an envelope to an insertion area. Using this method an envelope can be transported at a velocity of 85 to 100 inches per second to the backstop without any damage to the envelope. The envelope is automatically deskewed once it stops against the backstop. The vacuum and belt arrangement transports the envelope to the backstop without the use of any rollers, nips or any other positive drive. Thus the vacuum and belts can operate continuously without damage to the envelope. Once the envelope is release by the rollers in the arming station, the envelope is immediately controlled by the vacuum and belt arrangement. The vacuum drum is used to urge the envelope in a second direction as it comes under the control of the vacuum and belt arrangement.

Key to the reliability of the present invention is that the envelope transport is a continuous vacuum and moving belt non-positive drive transport. Thus there are no components that must be turned on and off, such as rollers, belts or other positive drive mechanisms, typically associated with positive drive systems. Also the automatic deskew is achieved with the continuous moving transport because of the nature of the non-positive drive of the vacuum and belt arrangement transporting the envelope against the backstop. Another benefit of the vacuum and belt arrangement is that the constant vacuum holds the lower panel of the envelope as the suction cups lift the upper panel of the envelope. In this manner the side guides pivot easily into the opened envelope.

The collation is introduced into the envelope by dual belt transport that maintains control of the trailing edge of the collation as the leading edge enters the opened envelope. Just as the dual belt transport is about to relinquish control of the collation the overhead pushers take control of the collation and complete the insertion of the collation into the envelope. The backstop begins to pivot out of the way as the overhead pushers push the stuffed envelope out of the insertion area. Thus there is positive control of the collation throughout the insertion process and of the stuffed envelop as it leaves the insertion area.

The vacuum drum gets the envelope around an arc without the use of a positive drive. The vacuum drum is used to move the envelope around the arc as it leaves the control of the rollers in the arming station and enters the control of the vacuum and belt arrangement.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. Apparatus for inserting enclosures into an envelope comprising:

an insertion section;

envelope transport means for transporting an envelope to said insertion section;

a plurality of backstops at the downstream end of said insertion section;

means for lifting open a top panel of the envelope when the envelope is against said backstops;

means for centering the envelope and means for guiding enclosures being conveyed for insertion into the envelope;

an enclosure transport assembly located upstream of said insertion section including a plurality of laterally spaced overhead pushers located above at least parts of said enclosure transport assembly and said insertion section; and a plurality of output belts located downstream from said insertion section and above said envelope transport belts;

wherein said overhead pushers seize the enclosures from said enclosure transport, stuff the enclosures into the opened envelope and push the stuffed envelope from the insertion section and into engagement by the output belts.

2. The apparatus of claim 1 further comprising an envelope staging section located upstream and below said insertion section, said envelope staging section including means for holding an envelope fed from an envelope feeder and forwarding the envelope to said envelope transport means.

3. The apparatus of claim 1 wherein said envelope transport means includes a vacuum deck located at said insertion section and a vacuum drum located upstream of and adjacent to said vacuum deck, said envelope transport means further including a plurality of envelope transport belts operating in cooperation with said vacuum drum and said vacuum deck, said vacuum deck and said vacuum drum each having vacuum means for holding a bottom panel of the envelope against said envelope transport belts.

4. The apparatus of claim 1 wherein said lifting means includes a pivoting sucker bar assembly.

5. The apparatus of claim 1 wherein said centering and guiding means include a pair of rotating funnel guide horns located at said insertion section.

6. The apparatus of claim 1 wherein said enclosure transport assembly includes a dual belted transport.

7. The apparatus of claim 1 further comprising a pair of output rollers located downstream of and adjacent to said backstops, said output rollers cooperating with said output belts remove the envelope from the insertion section.

8. Apparatus for inserting enclosures into an envelope comprising:

an insertion section;

an envelope staging section located upstream and below said insertion section, said envelope staging section including means for holding and forwarding an envelope fed from an envelope feeder;

an envelope transport means for transporting an envelope forwarded from said envelope staging section to said insertion section, said envelope transport means including a vacuum deck located at said insertion section and a vacuum drum located between said envelope staging section and said vacuum deck, said envelope transport means further including a plurality of continuously moving envelope transport belts operating in cooperation with said vacuum drum and said vacuum deck, said vacuum deck and said vacuum drum each having means for holding a bottom panel of the envelope against said envelope transport belts;

a plurality of backstops at the downstream end of said insertion section;

means for lifting open a top panel of the envelope when the envelope is against said backstops, said lifting means including a pivoting sucker bar assembly;

means for guiding enclosures being conveyed for insertion into the envelope, said guiding means including a pair of rotating funnel guide horns located at said insertion section;

an enclosure transport assembly located upstream of said insertion section, said enclosure transport assembly including a dual belted transport;

a plurality of laterally spaced overhead pushers located above at least parts of said enclosure transport assembly and said insertion section; and a plurality of output belts located downstream from said insertion section and above said envelope transport belts;

wherein said overhead pushers seize the enclosures from said enclosure transport, stuff the enclosures into the opened envelope and push the stuffed envelope from the insertion section into engagement by the output belts.

9. The apparatus of claim 8 further comprising a pair of output rollers located downstream of and adjacent to said backstops, said output rollers cooperating with said output belts remove the envelope from the insertion section.

10. The apparatus of claim 9 wherein said transport belts, said envelope staging section, said backstops, said pivoting sucker bar assembly, said rotating funnel guide horns, said overhead pushers and said dual belted transport are separately driven by servo motors.

11. A method of operating an insertion station of an inserting machine, comprising the steps of:

delivering an envelope to a staging area;

transporting the envelope from the staging area to a vacuum and belt transport system, said vacuum and belt transport system includes a plurality of commonly driven belts and a plurality of stationary vacuum ports disposed therebetween;

supplying vacuum to said vacuum ports and thereby attracting the envelope upon said commonly driven belts; carrying the envelope transported from the staging area around the periphery of a vacuum drum section of said vacuum and belt transport system to a vacuum deck section of said vacuum and belt transport system, said vacuum drum section including said stationary vacuum ports and a plurality of pulleys supporting said commonly driven belts;

stopping the envelope at an insertion area against a plurality of stop members extending through slots in said vacuum deck section said vacuum supply and said belts continuing while the envelope is stopped;

centering the envelope opening the envelope while the envelope is stopped at the insertion area;

delivering a collation to the insertion area;

providing means for guiding the collation into the envelope;

pushing the collation into the envelope; and pushing the envelope out of the insertion area as said stop members rotate out of the way.

12. The method of claim 11 wherein said step of pushing the collation into the envelope includes the steps of: providing overhead pushers to push the collation into the envelope and push the envelope out of the insertion area.

* * * * *